US009186803B2

(12) United States Patent
Higuchi et al.

(10) Patent No.: US 9,186,803 B2
(45) Date of Patent: Nov. 17, 2015

(54) ELECTRIC SHAVER

(75) Inventors: Katsuhiro Higuchi, Shiga (JP); Takashi Kozai, Shiga (JP); Shigekazu Minoura, Shiga (JP); Hiroyuki Okada, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 259 days.

(21) Appl. No.: 13/581,425

(22) PCT Filed: Mar. 24, 2011

(86) PCT No.: PCT/JP2011/057169

§ 371 (c)(1),
(2), (4) Date: Aug. 27, 2012

(87) PCT Pub. No.: WO2011/118703

PCT Pub. Date: Sep. 29, 2011

(65) Prior Publication Data

US 2013/0000126 A1 Jan. 3, 2013

(30) Foreign Application Priority Data

Mar. 26, 2010 (JP) ..... 2010-071579

(51) Int. Cl.
*B26B 19/38* (2006.01)
*B26B 19/14* (2006.01)

(52) U.S. Cl.
CPC ..... *B26B 19/384* (2013.01); *B26B 19/143* (2013.01); *B26B 19/38* (2013.01); *B26B 19/3893* (2013.01)

(58) Field of Classification Search
CPC .. B26B 19/384; B26B 19/3893; B26B 19/38; B26B 19/143
USPC ..... 30/34.2, 43.92, 43.7–43.9
See application file for complete search history.

(56) References Cited

U.S. PATENT DOCUMENTS

| | | | | |
|---|---|---|---|---|
| 2,877,548 | A * | 3/1959 | Starre | 30/346.51 |
| 2,948,063 | A * | 8/1960 | Jepson | 30/34.1 |
| 2,989,804 | A * | 6/1961 | Yellon | 30/32 |
| 3,064,349 | A * | 11/1962 | Fütterer et al. | 30/43.92 |
| 3,279,057 | A * | 10/1966 | Sanders | 30/43.3 |
| 3,498,891 | A * | 3/1970 | Futterer | 205/75 |

(Continued)

FOREIGN PATENT DOCUMENTS

| | | |
|---|---|---|
| EP | 0743144 | 11/1996 |
| EP | 1231034 | 8/2002 |

(Continued)

OTHER PUBLICATIONS

Search report from E.P.O., mail date is Jul. 18, 2013.

(Continued)

*Primary Examiner* — Sean Michalski
(74) *Attorney, Agent, or Firm* — Greenblum & Bernstein, P.L.C.

(57) ABSTRACT

An electric shaver includes an outer blade having blade holes defined by a frame, and an inner blade provided inside the outer blade to move relative to the outer blade and cut body hair inserted into the blade holes. Circumferences of the blade holes of the frame are bent toward the inner blade so as to provide hair lifting portions having rounded portions in the frame, and the frame provided with the hair lifting portions is located closer to a skin than to a surface of the inner blade on a skin side.

7 Claims, 27 Drawing Sheets

(56) References Cited

U.S. PATENT DOCUMENTS

| | | | | | |
|---|---|---|---|---|---|
| 3,650,849 | A | * | 3/1972 | Nidetzky | 148/643 |
| 3,653,900 | A | * | 4/1972 | Black | 430/5 |
| 3,714,807 | A | | 2/1973 | Grunberer | |
| 3,756,105 | A | * | 9/1973 | Balamuth et al. | 83/14 |
| 3,869,790 | A | * | 3/1975 | Ihasz | 30/537 |
| 3,940,851 | A | * | 3/1976 | Rookus | 30/34.2 |
| 4,105,493 | A | * | 8/1978 | Chauvy | 216/48 |
| 4,139,940 | A | * | 2/1979 | Buras et al. | 30/43.92 |
| 4,184,250 | A | * | 1/1980 | Meijer | 30/346.51 |
| 4,343,089 | A | * | 8/1982 | Suzuki et al. | 30/346.51 |
| 4,451,984 | A | * | 6/1984 | Shimazu | 30/346.52 |
| 4,575,941 | A | * | 3/1986 | Packham | 30/346.51 |
| 5,390,416 | A | * | 2/1995 | Uchiyama et al. | 30/43.6 |
| 5,857,260 | A | * | 1/1999 | Yamada et al. | 30/346.51 |
| 5,867,908 | A | * | 2/1999 | Van Veen et al. | 30/43.6 |
| 6,178,641 | B1 | * | 1/2001 | Meijer | 30/43.92 |
| 6,951,056 | B2 | * | 10/2005 | Kameoka et al. | 30/346.51 |
| 7,357,052 | B2 | * | 4/2008 | Denne | 76/104.1 |
| 7,540,090 | B2 | * | 6/2009 | Nakano | 30/43.6 |
| 8,037,613 | B2 | * | 10/2011 | Everett et al. | 30/346.51 |
| 2005/0223560 | A1 | | 10/2005 | Walls | |
| 2007/0056166 | A1 | | 3/2007 | Shiba et al. | |
| 2008/0134523 | A1 | | 6/2008 | Komori et al. | |
| 2010/0126022 | A1 | | 5/2010 | Shiba et al. | |
| 2013/0125401 | A1 | | 5/2013 | Shiba et al. | |

FOREIGN PATENT DOCUMENTS

| | | |
|---|---|---|
| EP | 1685931 | 8/2006 |
| EP | 1930137 | 6/2008 |
| JP | 56-50994 | 12/1981 |
| JP | 57-121268 | 7/1982 |
| JP | 59-017381 | 1/1984 |
| JP | 59-21635 | 5/1984 |
| JP | 59-146689 | 8/1984 |
| JP | 1-274793 | 11/1989 |
| JP | 3083548 | 6/2000 |
| JP | 2008-142275 | 6/2008 |

OTHER PUBLICATIONS

U.S. Appl. No. 13/581,416 to Hiroaki Shimizu et al., filed Aug. 27, 2012.

U.S. Appl. No. 13/581,419 to Hiroaki Shimizu et al., filed Aug. 27, 2012.

Search Report from Chinese Patent Office in counterpart Chinese Patent Application No. 201180011927.X and an English translation thereof.

* cited by examiner (a)

(b)

(c)

(a)

(b)

(c)

(a)

(b)

(c)

(a)

(b)

(a)

(b)

(a)

(b)

(c)

(a)

(b)

(c)

(a)

(b)

(c)

(a)

(b)

(c)

(a)

(b)

(c)

(a)

(b)

ELECTRIC SHAVER

TECHNICAL FIELD

The present invention relates to an electric shaver.

BACKGROUND ART

Various types of electric shavers to shave body hair have been developed. Herein, an angle formed by the extending direction of body hair and a skin surface is called a hair rising angle. Although body hair with a large hair rising angle (for example, 45° to 60°) is easy to shave, it is difficult to shave body hair with a small hair rising angle (for example, 30° or less), that is, lying body hair. Thus, electric shavers provided with hair lifting portions in frames of outer blades having a hair lifting ability higher than conventional hair lifting portions have been developed (for example, refer to Patent Document 1).

CITATION LIST

Patent Literature

Patent Document 1: Japanese Patent No. 3083548

SUMMARY OF THE INVENTION

However, in the conventional electric shavers, the hair lifting portions provided on the frames have tips formed into a sharp edge. Thus, the skin may be damaged by the hair lifting portions having the sharp tips.

It is an object of the present invention to provide an electric shaver capable of improving performance of introduction of lying body hair into outer blades while preventing an influence on skin.

In order to solve the above-described problem, an electric shaver according to the present invention includes: an outer blade having blade holes defined by a frame; and an inner blade provided inside the outer blade to move relative to the outer blade and cut body hair inserted into the blade holes, wherein circumferences of the blade holes of the frame are bent toward the inner blade so as to provide hair lifting portions having rounded portions in the frame, and the frame provided with the hair lifting portions is located closer to a skin than to a surface of the inner blade on a skin side.

According to the present invention, since the circumferences of the blade holes of the frame are bent toward the inner blade so as to provide the hair lifting portions having the rounded portions in the frame, an influence on the skin can be prevented. In addition, since the frame provided with the hair lifting portions is located closer to the skin than to the surface of the inner blade on the skin side, it is possible to improve performance of introduction of the lying body hair into the outer blade. Therefore, according to the present invention, it is possible to improve performance of introduction of the lying body hair into the outer blade while preventing an influence on the skin.

BRIEF DESCRIPTION OF THE DRAWINGS

FIG. 6(*a*) is an enlarged schematic view of the outer blade, FIG. 6(*b*) is a cross-sectional view taken along the line A-A in FIG. 6(*a*) before processing the frame, and FIG. 6(*c*) is a cross-sectional view taken along the line A-A in FIG. 6(*a*) after processing the frame.

FIG. 8(*a*) is an enlarged schematic view of an outer blade, FIG. 8(*b*) is a cross-sectional view taken along the line B-B in FIG. 8(*a*) before processing the frame, and FIG. 8(*c*) is a cross-sectional view taken along the line B-B in FIG. 8(*a*) after processing the frame.

FIG. 10(*a*) is an enlarged schematic view of an outer blade, FIG. 10(*b*) is a cross-sectional view taken along the line C-C in FIG. 10(*a*) before processing the frame, and FIG. 10(*c*) is a cross-sectional view taken along the line C-C in FIG. 10(*a*) after processing the frame.

FIG. 14(*a*) is an enlarged schematic view of an outer blade, and FIG. 14(*b*) is a cross-sectional view taken along the line D-D in FIG. 14(*a*).

FIG. 16(*a*) is an enlarged schematic view of an outer blade, and FIG. 16(*b*) is a cross-sectional view taken along the line E-E in FIG. 16(*a*).

FIG. 18(*a*) is an enlarged schematic view of an outer blade, and FIG. 18(*b*) is a cross-sectional view taken along the line F-F in FIG. 18(*a*).

FIG. 19(*a*) is a cross-sectional view schematically showing a main part of the electric shaver in a hair lifting state, and FIG. 19(*b*) is a cross-sectional view schematically showing the main part of the electric shaver in a body hair cutting state.

FIG. 20(*a*) is an enlarged schematic view of an outer blade, and FIG. 20(*b*) is a cross-sectional view taken along the line G-G in FIG. 20(*a*).

FIG. 22(*a*) is an enlarged schematic view of an outer blade, and FIG. 22(*b*) is a cross-sectional view taken along the line H-H in FIG. 22(*a*).

FIG. 24(*a*) is an enlarged schematic view of an outer blade, FIG. 24(*b*) is a cross-sectional view taken along the line I-I in FIG. 24(*a*) before processing the frame, and FIG. 24(*c*) is a cross-sectional view taken along the line I-I in FIG. 24(*a*) after processing the frame.

FIG. 26(*a*) is an enlarged schematic view of an outer blade, FIG. 26(*b*) is a cross-sectional view taken along the line J-J in FIG. 26(*a*) before processing the frame, and FIG. 26(*c*) is a cross-sectional view taken along the line J-J in FIG. 26(*a*) after processing the frame.

FIG. 27(*a*) is a cross-sectional view schematically showing a main part of the electric shaver in a hair lifting state, and FIG. 27(*b*) is a cross-sectional view schematically showing the main part of the electric shaver in a body hair cutting state.

FIG. 28(*a*) is an enlarged schematic view of an outer blade, FIG. 28(*b*) is a cross-sectional view taken along the line K-K in FIG. 28(*a*) before processing the frame, and FIG. 28(*c*) is a cross-sectional view taken along the line K-K in FIG. 28(*a*) after processing the frame.

FIG. 29(*a*) is an enlarged schematic view of an outer blade, FIG. 29(*b*) is a cross-sectional view taken along the line L-L in FIG. 29(*a*) before processing the frame, and FIG. 29(*c*) is a cross-sectional view taken along the line L-L in FIG. 29(*a*) after processing the frame.

FIG. 31(*a*) is an enlarged schematic view of an outer blade, FIG. 31(*b*) is a cross-sectional view taken along the line M-M in FIG. 31(*a*) before processing the frame, and FIG. 31(*c*) is a cross-sectional view taken along the line M-M in FIG. 31(*a*) after processing the frame.

FIG. 36(*a*) is an enlarged view of a main part of the outer blade of which blade holes are formed into a hexagonal shape, and FIG. 36(*b*) is an enlarged view showing a main part of the outer blade of which blade holes are formed into a slit-like shape.

DESCRIPTION OF THE EMBODIMENTS

Figure 1:
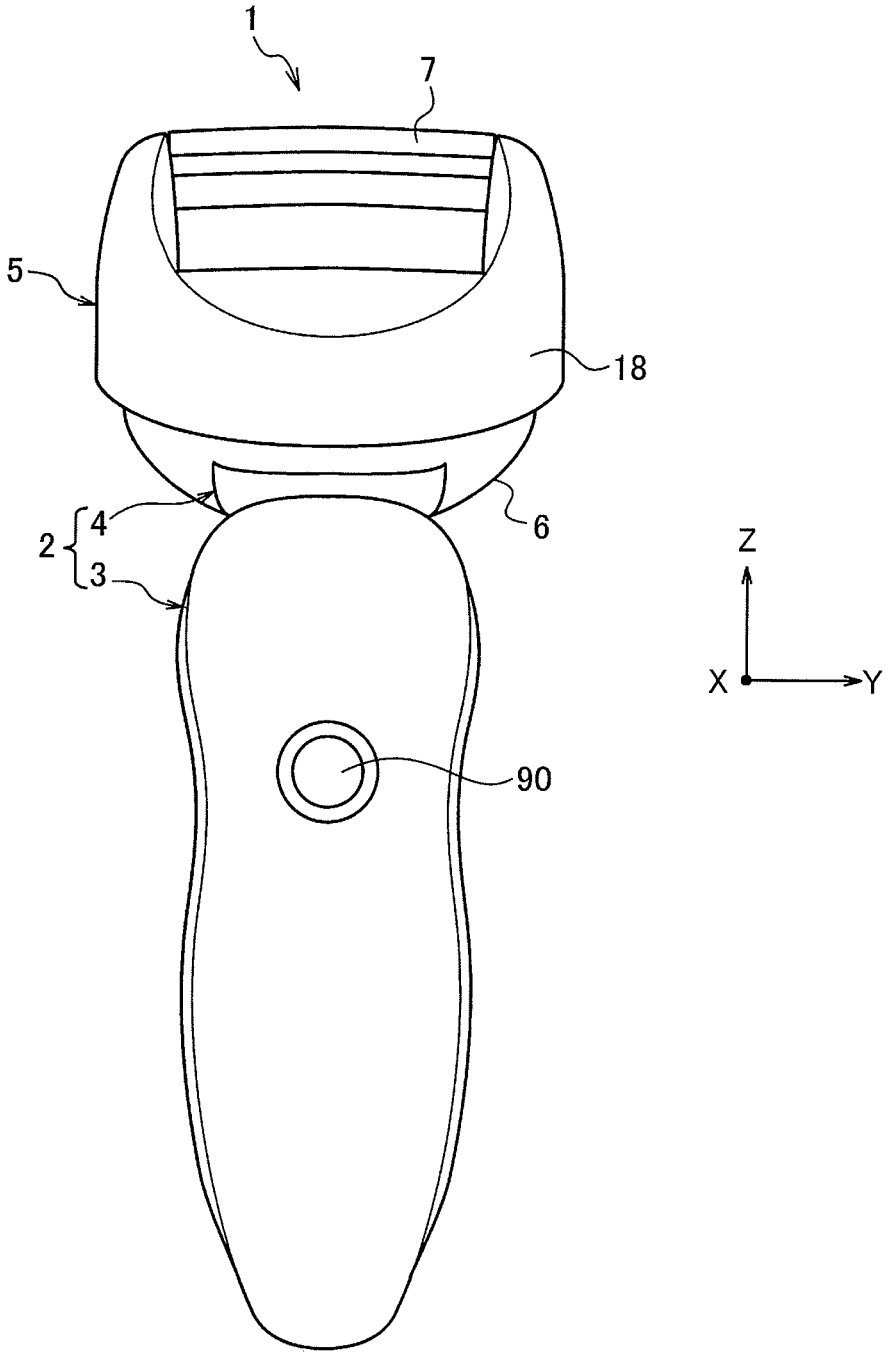
FIG. 1 is a front view showing an electric shaver according to a first embodiment of the present invention.

Hereinafter, embodiments according to the present invention will be described in detail below with reference to the drawings. Note that the respective embodiments described below include the identical components. Thus, those components are indicated by the common reference numerals and the overlapped explanations thereof will not be repeated. In the following description, the direction in which plural outer blades are arranged parallel to each other is referred to as a front-back direction (a shaving direction) X, and the direction in which the respective outer blades extend is referred to as a right-left direction Y. In addition, the vertical direction in a state where a head unit is positioned in such a manner that the outer blades face upward is referred to as a vertical direction Z.

First Embodiment

As shown in FIG. 1, an electric shaver 1 according to the present embodiment includes a grip section 2 held by a hand, and a head unit 5 fixed to the grip section 2.

The grip section 2 includes a grip main body 3 made of synthetic resin installed with a battery (not shown in the figures.), and a grip joint 4 made of synthetic resin projecting rearward from the upper surface of the grip main body 3. Note that at least one of a known right-left swinging mechanism and a known front-back swinging mechanism may be provided on the upper surface of the grip joint 4 so that the head unit 5 attached to the grip section 2 can swing in the right-left direction or in the front-back direction.

The head unit 5 includes a linear head portion 6 installed with a linear motor (not shown in figures.) and connected to the grip joint 4, and a blade unit 7 attached to the linear head portion 6. As shown in FIG. 1, the grip main body 3 is provided with a switch 90 configured to turn a drive of the linear motor on or off. The grip main body 3 may be provided with a display for displaying, for example, a charging state of the battery.

The blade unit 7 includes outer blades 8 exposed on the upper surface of the heat unit 5, and inner blades 13 provided inside the outer blades 8 (below the outer blades 8) to move relative to the outer blades 8.

According to the present embodiment, the outer blades 8 include four (plural) blades of a first net blade 9, a finishing net blade 10, a slit blade 11 and a second net blade 12 arranged parallel to each other in the front-back direction X.

Figure 4:
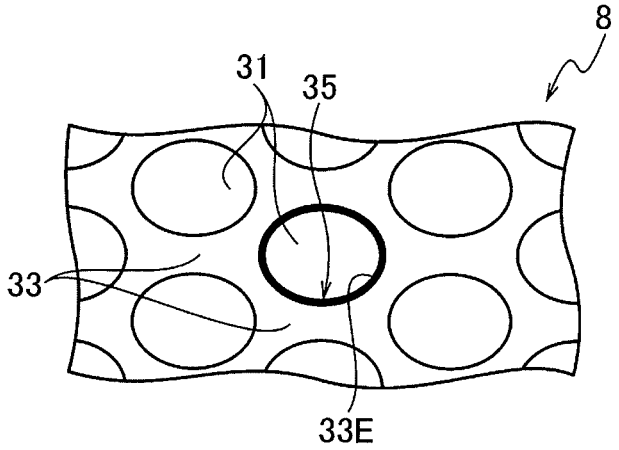
FIG. 4 is an enlarged view schematically showing a main part of an outer blade of the electric shaver according to the first embodiment of the present invention.

Each of the net blades 9, 10 and 12 is curved into an inverted U-shape in the front-back direction (in the short-side direction) X so as to project upward in a side view (when the outer blades are viewed in the right-left direction Y), as shown in FIG. 4. In addition, each of the net blades 9, 10 and 12 is slightly curved in the right-left direction (in the longitudinal direction) Y so as to project upward in a front view (when the outer blades are viewed in the front-back direction X). Although the respective net blades 9, and 12 are curved so as to project upward in the front view, the outer blades are not necessarily curved.

Figure 2:
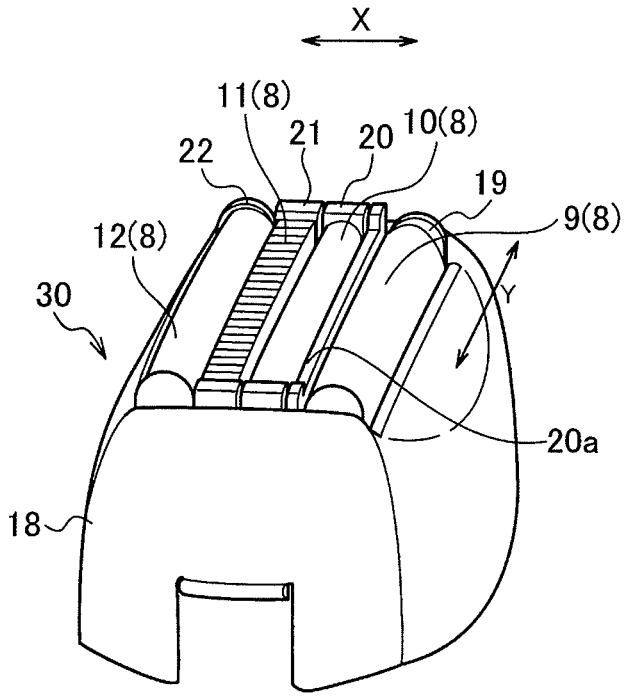
FIG. 2 is a perspective view schematically showing an outer blade cassette according to the first embodiment of the present invention.
Figure 5:
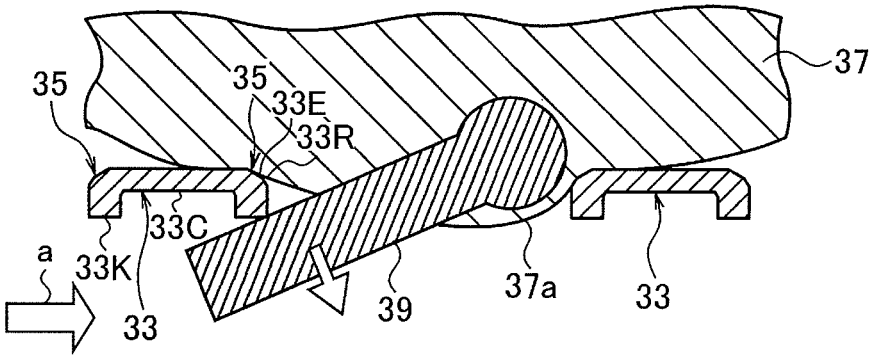
FIG. 5 is a cross-sectional view schematically showing a main part of the electric shaver in a used state according to the first embodiment of the present invention.

The net blades 9, 10 and 12 are provided with a number of blade holes 31 having an oval shape defined by a frame 33 (see FIG. 4). According to the present embodiment, as shown in FIG. 2, the blade width of the finishing net blade 10 (the width in the front-back direction X) is set smaller than the blade widths of the first and second net blades 9 and 12 (the widths in the front-back direction X). Since the blade width of the finishing net blade 10 is smaller than the blade widths of the first and second blades 9 and 12, that is, since the radius of curvature of the finishing net blade 10 is small, a skin 37 pressed against the surface of the finishing net blade 10 greatly projects inward from the blade holes 31 so that a body hair 39 (see FIG. 5) can be cut shorter.

The slit blade 11 is curved into an angular U-shape in the front-back direction (in the short-side direction) X, and provided with a number of slits (blade holes) pierced from the flat upper wall to the side walls.

In other words, the slit blade 11 is provided with the multiple slits (the blade holes) defined by substantially angular U-shaped frames from the flat upper wall to the side walls and frames extending in the longitudinal direction (in the right-left direction) Y at the bottom of the side walls.

The net blades 9, 10 and 12 and the slit blade 11 constituting the outer blades 8 are attached to corresponding outer blade rims 19, 20, 22 and 21, respectively.

The outer blade rim 20 is provided with a skin guard member 20*a* on the first net blade 9 side. The slit blade 11 and the skin guard member 20*a* interposing the finishing net blade 10 prevent the skin 37 from being strongly pressed against the finishing net blade 10 having a small radius of curvature.

The outer blade rim 19 to which the first net blade 9 is attached, the outer blade rim 20 to which the finishing net blade 10 is attached, the outer blade rim 21 to which the slit blade 11 is attached, and the outer blade rim 22 to which the second net blade 12 is attached are respectively engaged to an outer blade frame 18 to constitute an outer blade cassette 30. The outer blade cassette 30 is attached to the linear head portion 6.

Figure 3:
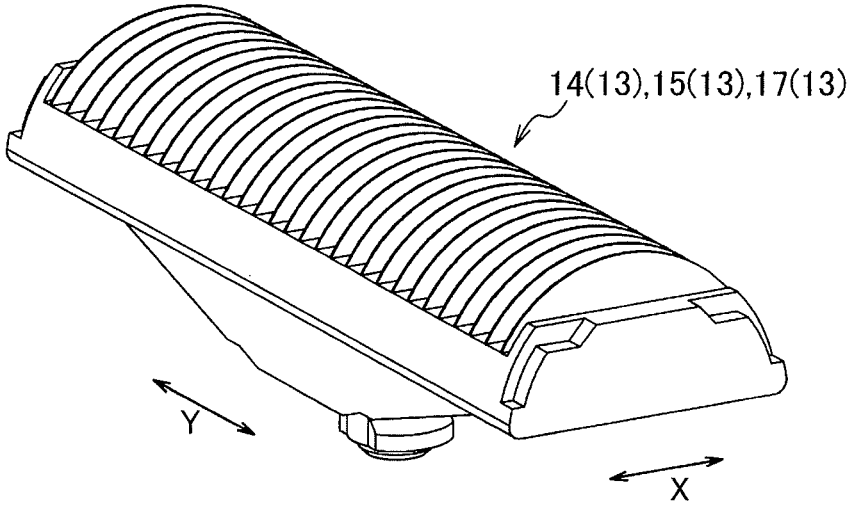
FIG. 3 is a perspective view showing an inner blade according to the first embodiment of the present invention.

The net blades 9, 10 and 12 and the slid blade 11 constituting the outer blades 8 are provided with the dedicated inner blades 13, respectively. In particular, inner blades 14, 15 and 17 formed into an inverted U-shape are provided under (inside) the corresponding net blades 9, 10 and 12 to conform to the curved shapes of the respective net blades 9, 10 and 12 (see FIG. 3). Here, a slit inner blade (not shown in figures.) formed into an angular U-shape is provided under (inside) the slit blade 11 to conform to the curved shape of the slit blade 11.

The respective inner blades 14, 15 and 17 and the slit inner blade (not shown in figures.) are attached to the linear motor described above (not shown in figures.). Once the linear motor is driven, the inner blades 14, 15 and 17 and the slit inner blade (not shown in figures.) start reciprocating movement in the right-left direction (in the longitudinal direction) Y, respectively.

When the inner blades 14, 15 and 17 and the slit inner blade (not shown in figures.) provided under (inside) the respective net blades 9, 10 and 12 and the slit blade 11 move relative to the respective net blades 9, 10 and 12 and the slit blade 11 (reciprocate in the right-left direction Y), the body hair 39 inserted in the blade holes 31 of the respective net blades 9, 10 and 12 and the slits of the slit blade 11 are cut by the inner blades 14, 15 and 17 and the slit inner blade (not shown in figures.) in cooperation with the respective net blades 9, 10 and 12 and the slit blade 11.

According to the present embodiment, the frame 33 is provided with hair lifting portions 35 having a function to efficiently lift the body hair (the lying body hair) 39 at a small angle to a skin surface 37*a*.

In the present embodiment, the entire circumferences of the blade holes 31 of the frame 33 are bent toward the inner blade 13 so as to provide the hair lifting portions 35 having rounded portions in the frame 33 (see FIG. 4). In FIG. 4, the portion provided with the hair lifting portion 35 in the frame 33 is indicated by the thick line. Although FIG. 4 shows the case in which only one of the plural blade holes 31 is provided with the hair lifting portion 35 along the circumference thereof, the present embodiment is not limited to this case, and the plural blade holes 31 may be provided with the hair lifting portions 35 along the circumferences thereof.

Here, it is preferable to determine the regions provided with the hair lifting portions 35 and the regions not provided with the hair lifting portions 35 in accordance with contact pressure between the outer blades 8 and the skin 37. In particular, it is preferable to provide the hair lifting portions 35 in the portions with low contact pressure between the outer blades 8 and the skin 37 and not to provide the hair lifting portions 35 in the portions with high contact pressure between the outer blades 8 and the skin 37. Accordingly, an influence (damage) on the skin 37 due to the portions with high contact pressure with respect to the skin 37 is suppressed.

Figure 6:
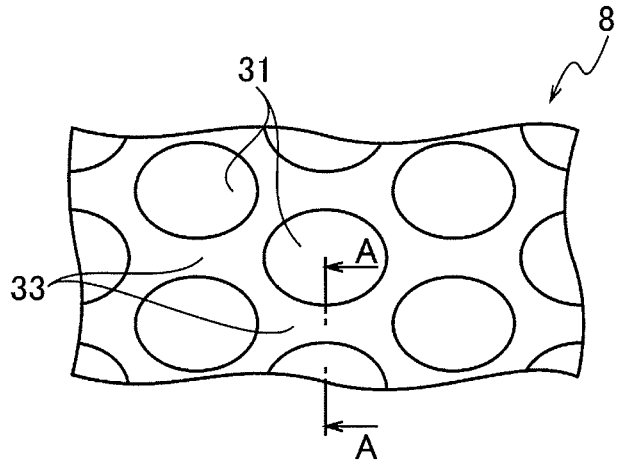
FIG. 6 is a view showing a process of processing a frame of the electric shaver according to the first embodiment of the present invention.
Figure 6:
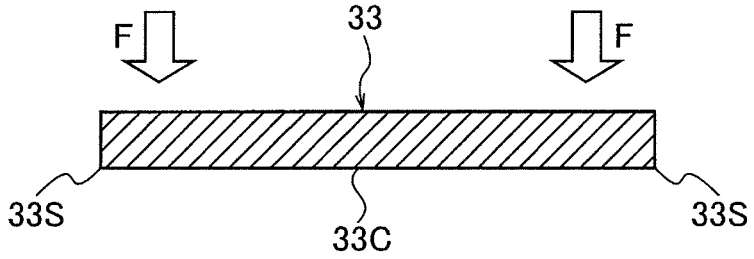
Figure 6:
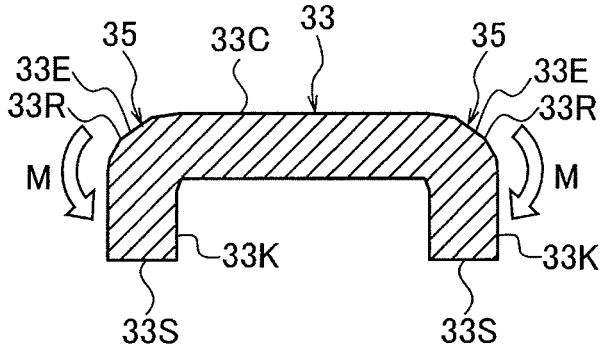

The following is an explanation of a method for manufacturing the hair lifting portions 35 with reference to FIG. 6.

As shown in FIG. 6(*a*), the outer blade 8 in which a number of the blade holes 31 having an oval shape are defined by the frame 33 is formed. In the step of forming the blade holes 31 in the outer blade 8, the frame 33 defining the blade holes 31 of the outer blade 8 is a thin flat plate as shown in FIG. 6(*b*).

Then, a load F is applied from the skin 37 side to both side portions (the circumferences of the blade holes 31 of the frame 33) 33S of the plate-like frame 33 to cause a turning force M, so that the both side portions (the circumferences of the blade holes 31 of the frame 33) 33S are bent at an approximately right angle to a center portion 33C to form side walls 33K as shown in FIG. 6(*c*). Accordingly, the hair lifting portions 35 having a function to efficiently lift the body hair (the lying body hair) 39 at a small angle to the skin surface 37*a* are formed in the frame 33. In this case, the hair lifting portions 35 are bent to have rounded portions, and the frame 33 provided with the hair lifting portions 35 is located closer to the skin 37 than to a surface 50 of the inner blade 13 on the skin 37 side (see FIG. 32). Thus, the frame 33 is formed into an approximately inverted angular U-shape in cross-section provided with edges 33E having rounded portions 33R on the skin 37 side. According to the present embodiment, the edges 33E in the frame 33 serve as the hair lifting portions 35 having a function to efficiently lift the body hair (the lying body hair) 39 at a small angle to the skin surface 37*a*.

As described above, according to the present embodiment, the both side portions 33S of the frame 33 (the circumferences of the blade holes 31 of the frame 33) are bent at an approximately right angle to the center portion 33C so as to provide the hair lifting portions 35 having the rounded portions 33R in the frame 33. Due to the hair lifting portions 35 having the rounded portions 33R, an influence on the skin 37 can be prevented.

In addition, since the frame 33 provided with the hair lifting portions 35 is located closer to the skin 37 than to the surface 50 of the inner blade 13 on the skin 37 side, it is possible to bring the hair lifting portions 35 closer to the skin 37 and thereby lift the body hair 39 more efficiently.

Thus, according to the present embodiment, it is possible to improve performance of introduction of the lying body hair 39 into the outer blades 8 while preventing an influence on the skin 37.

Further, according to the present embodiment, the hair lifting portions 35 capable of efficiently lifting the body hair are provided by the simple process only to bend the circumferences of the blade holes 31 of the frame 33 (the both side portions 33S of the frame 33). As a result, the electric shaver 1 produced at a low cost with high quality can be provided.

Still further, according to the present embodiment, the entire circumferences of the blade holes 31 of the frame 33 (the both side portions 33S of the frame 33) are bent toward the inner blades 13 so that the edges 33E serving as the hair lifting portions 35 are provided in the frame 33. Accordingly, whichever direction the electric shaver 1 moves on the skin surface 37*a*, the body hair 39 can be lifted up more efficiently and therefore, the efficiency of shaving the body hair 39 can be improved.

Second Embodiment

Figure 7:
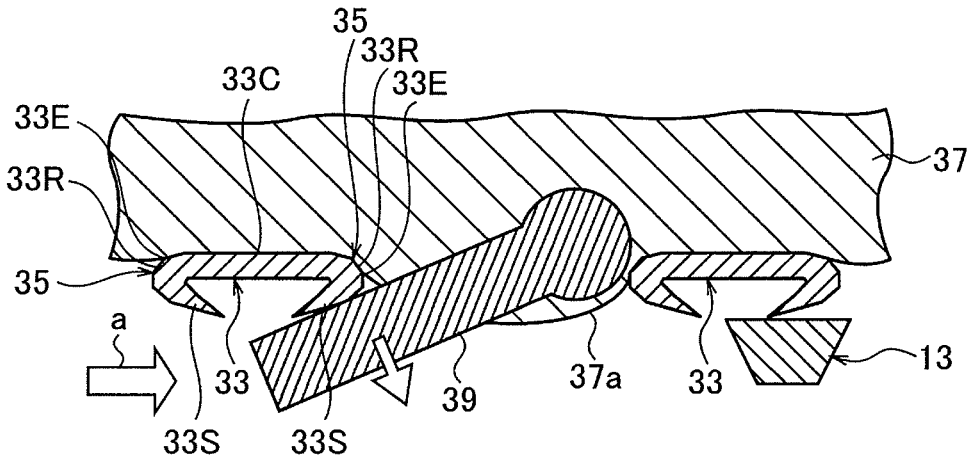
FIG. 7 is a cross-sectional view schematically showing a main part of an electric shaver in a used state according to a second embodiment of the present invention.

As shown in FIG. 7, the frame 33 of the outer blade 8 according to the present embodiment is formed into an approximately C-shape in cross section, in which the both side portions (the circumferences of the blade holes 31 of the frame 33) 33S having a tapered shape are bent inward and toward the inner blade 13. The frame 33 on the skin 37 side is provided with the edges 33E having the rounded portions 33R to serve as the hair lifting portions 35 that have a function to efficiently lift the body hair (the lying body hair) 39 at a small angle to the skin surface 37*a*.

In the present embodiment, as in the case of the preceding embodiment, the entire circumferences of the blade holes 31 of the frame 33 (the both side portions 33S of the frame 33) are bent toward the inner blade 13 so as to provide the hair lifting portions 35 having the rounded portions in the frame 33. In addition, the frame 33 provided with the hair lifting portions 35 is located closer to the skin 37 than to the surface 50 of the inner blade 13 on the skin 37 side (see FIG. 32).

Figure 8:
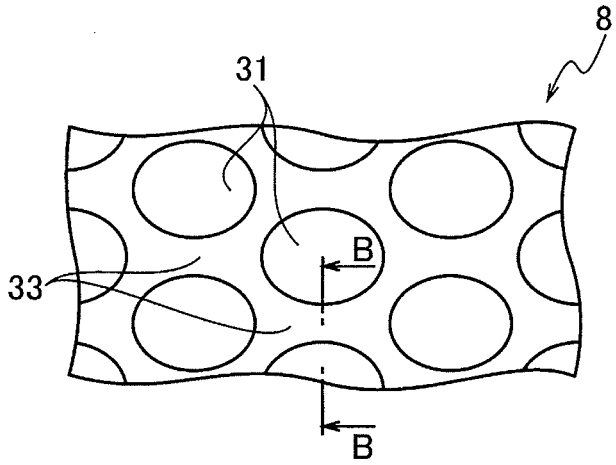
FIG. 8 is a view showing a process of processing a frame of the electric shaver according to the second embodiment of the present invention.
Figure 8:
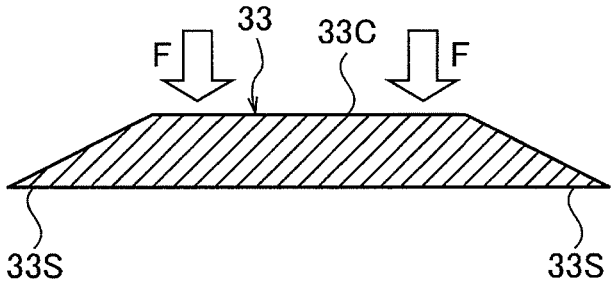
Figure 8:
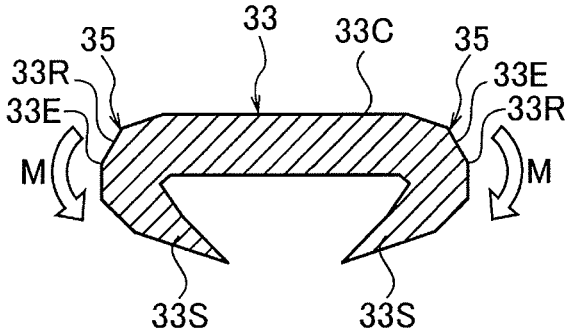

The following is an explanation of a method for manufacturing the hair lifting portions 35 with reference to FIG. 8.

As shown in FIG. 8(*a*), the outer blade 8 in which a number of the blade holes 31 having an oval shape are defined by the frame 33 is formed. As shown in FIG. 8(*b*), in the step of forming the blade holes 31 in the outer blade 8, the frame 33 defining the blade holes 31 of the outer blade 8 is formed into an approximately trapezoidal shape provided with the edges 33E having an acute angle on the inner blade 13 side (on the opposite side of the skin 37) at the circumferences of the blade holes 31 in the frame 33. Then, the load F is applied from the skin 37 side to the both side portions (the circumferences of the blade holes 31 of the frame 33) 33S of the frame 33 provided with the edges 33E to cause the turning force M, so that the both side portions (the circumferences of the blade holes 31 of the frame 33) 33S are bent inward and toward the inner blade 13 as shown in FIG. 8(*c*). Thus, the frame 33 is formed into an approximately C-shape in cross-section provided with the edges 33E on the skin 37 side. In the present embodiment, as in the case of the preceding embodiment, the edges 33E in the frame 33 serve as the hair lifting portions 35 that have a function to efficiently lift the body hair (the lying body hair) 39 at a small angle to the skin surface 37*a*.

According to the present embodiment, the same functions and effects as the first embodiment can be achieved.

Further, according to the present embodiment, the both side portions (the circumferences of the blade holes 31 of the frame 33) 33S of the frame 33 before processing are formed into a tapered shape. Thus, the both side portions (the circumferences of the blade holes 31 of the frame 33) 33S can be bent with a low load.

Third Embodiment

Figure 9:
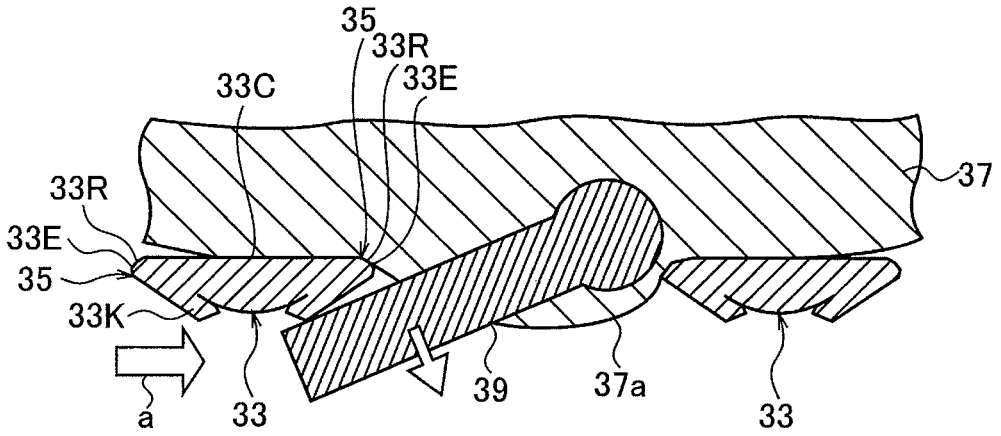
FIG. 9 is a cross-sectional view schematically showing a main part of an electric shaver in a used state according to a third embodiment of the present invention.

As shown in FIG. 9, the frame 33 of the outer blade 8 according to the present embodiment is formed into an approximately inverted trapezoidal shape in cross section, in which the both side portions (the circumferences of the blade holes 31 of the frame 33) 33S are formed into a tapered shape. The frame 33 on the skin 37 side is provided with the edges 33E having the rounded portions 33R to serve as the hair lifting portions 35 that have a function to efficiently lift the body hair (the lying body hair) 39 at a small angle to the skin surface 37*a*.

In the present embodiment, as in the case of the preceding embodiments, the entire circumferences of the blade holes 31 of the frame 33 (the both side portions 33S of the frame 33) are bent toward the inner blade 13 so as to provide the hair lifting portions 35 having the rounded portions in the frame 33. In addition, the frame 33 provided with the hair lifting portions 35 is located closer to the skin 37 than to the surface 50 of the inner blade 13 on the skin 37 side (see FIG. 32).

The following is an explanation of a method for manufacturing the hair lifting portions 35 with reference to FIG. 8.

As shown in FIG. 8(*a*), the outer blade 8 in which a number of the blade holes 31 having an oval shape are defined by the frame 33 is formed. As shown in FIG. 8(*b*), in the step of forming the blade holes 31 in the outer blade 8, the frame 33 defining the blade holes 31 of the outer blade 8 is formed into an approximately inverted angular U-shape provided with the side walls 33K on both sides of the frame 33. Then, the load F is applied to the both side walls 33K from the both sides to cause the turning force M, so that the both side walls 33K are bent until coming into contact with the surface of the center portion 33C on the inner blade 13 side as shown in FIG. 8(*c*). Thus, the frame 33 is formed into an inverse tapered shape in cross-section provided with the edges 33E having an acute angle on the skin 37 side.

Since the both side portions (the circumferences of the blade holes 31 of the frame 33) 33S of the frame 33 are provided with the edges 33E having the rounded portions 33R on the skin 37 side, as shown in FIG. 9, the front portion of the side portion 33S (the edge 33E of the frame 33) having an inverse tapered shape is easily inserted into the gap between the lying body hair 39 and the skin surface 37*a* when the outer blade 8 moves on the skin 37 in the direction of an arrow a.

According to the present embodiment, the same functions and effects as the first embodiment can be achieved.

In the present embodiment, the frame 33 is formed into an inverse tapered shape in cross-section provided with the edges 33E on the skin 37 side. As a result, the edge 33E serving as the hair lifting portion 35 is easily inserted into the gap between the lying body hair 39 and the skin surface 37*a*. Accordingly, it is possible to efficiently lift the body hair (the lying body hair) 39 at a small angle to the skin surface 37*a* due to the edges 33E.

Next, modified examples of the frame of the present embodiment will be described.

First Modified Example

Figure 11:
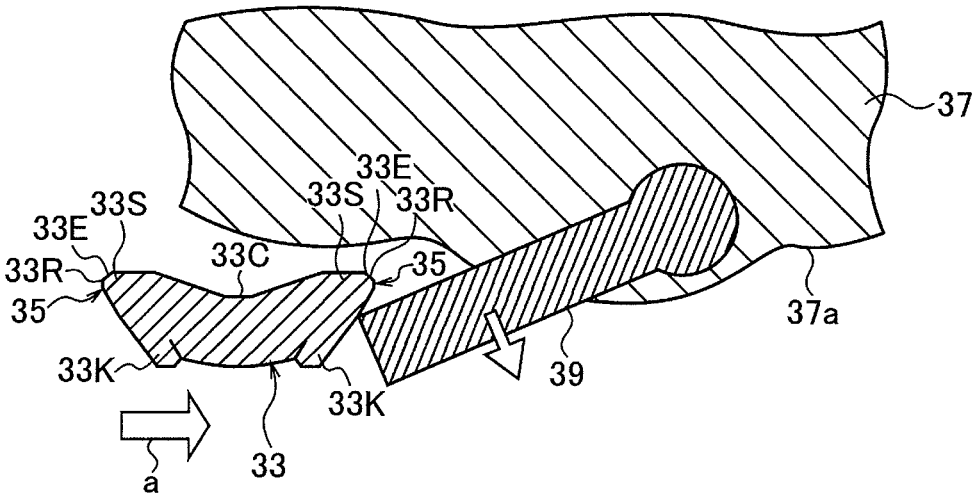
FIG. 11 is a cross-sectional view schematically showing a main part of an electric shaver in a used state according to a first modified example of the third embodiment of the present invention.

As shown in FIG. 11, the frame 33 of the outer blade 8 according to the present modified example is formed into an approximately crescent shape in cross-section, in which the both side portions (the circumferences of the blade holes 31 of the frame 33) 33S are formed into a tapered shape to have the rounded portions, and the center portion 33C on the skin 37 side is dented toward the inner blade 13.

The frame 33 is provided with the edges 33E having the rounded portions 33R to serve as the hair lifting portions 35 that have a function to efficiently lift the body hair (the lying body hair) 39 at a small angle to the skin surface 37*a*.

In the present modified example, as in the case of the preceding embodiments, the entire circumferences of the blade holes 31 of the frame 33 (the both side portions 33S of the frame 33) are bent toward the inner blade 13 so as to provide the hair lifting portions 35 having the rounded portions in the frame 33. In addition, the frame 33 provided with the hair lifting portions 35 is located closer to the skin 37 than to the surface 50 of the inner blade 13 on the skin 37 side (see FIG. 32).

Figure 10:
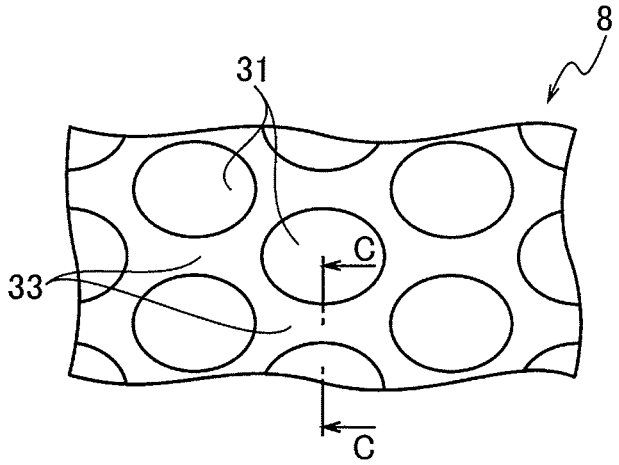
FIG. 10 is a view showing a process of processing a frame of the electric shaver according to the third embodiment of the present invention.
Figure 10:
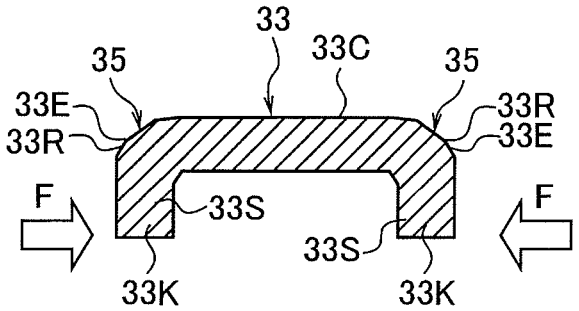
Figure 10:
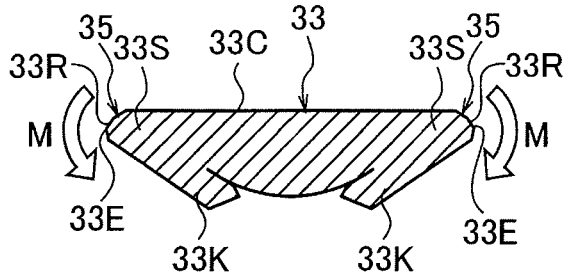

The hair lifting portions 35 of the present modified example can be obtained by bending the frame 33 having an inverse tapered shape shown in FIG. 10(*c*) in such a manner that the upper surface of the center portion 33C (the surface on the skin 37 side) is dented toward the inner blade 13.

According to the present modified example, the same functions and effects as the third embodiment can be achieved.

According to the present modified example, since the edges 33E project toward the skin 37 above the level of the center portion 33C, the edges 33E can be pressed against the skin 37 more strongly and therefore, the efficiency of shaving the body hair 39 can be further improved.

In the present modified example, since the both side portions (the circumferences of the blade holes 31 of the frame 33) 33S of the plate-like frame 33 are bent toward the inner blade 13, the contact surface with the skin 37 is not flat. Therefore, it is possible to prevent the skin 37 from slipping on the contact surface. As a result, the edges 33E serving as the hair lifting portions 35 can come into closer contact with the skin 37 and thereby lift the lying body hair 39 up more efficiently.

Second Modified Example

Figure 12:
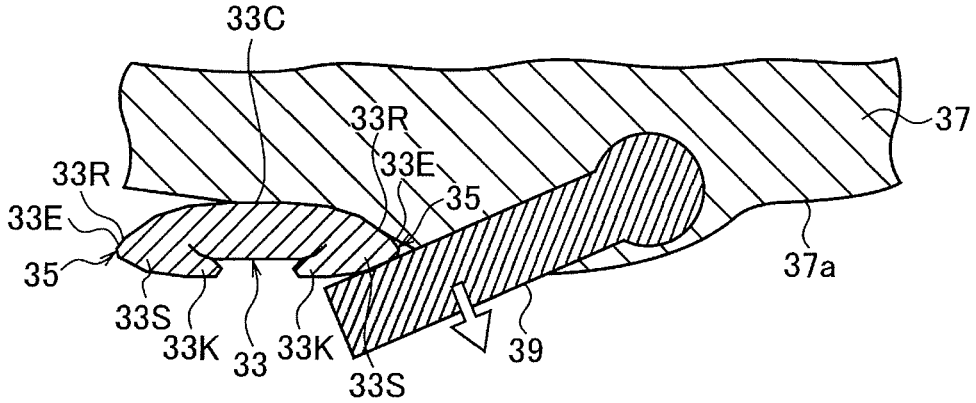
FIG. 12 is a cross-sectional view schematically showing a main part of an electric shaver in a used state according to a second modified example of the third embodiment of the present invention.

As shown in FIG. 12, the frame 33 of the outer blade 8 according to the present modified example is gently curved in such a manner that the upper surface of the center portion 33C (the surface on the skin 37 side) projects toward the skin 37. In addition, the frame 33 is provided with the edges 33E having the rounded portions 33R to serve as the hair lifting portions 35 that have a function to efficiently lift the body hair (the lying body hair) 39 at a small angle to the skin surface 37*a*.

In the present modified example, as in the case of the preceding embodiments, the entire circumferences of the blade holes 31 of the frame 33 (the both side portions 33S of the frame 33) are bent toward the inner blade 13 so as to provide the hair lifting portions 35 having the rounded portions in the frame 33. In addition, the frame 33 provided with the hair lifting portions 35 is located closer to the skin 37 than to the surface 50 of the inner blade 13 on the skin 37 side (see FIG. 32).

The hair lifting portions 35 of the present modified example can be obtained by bending the frame 33 having an inverse tapered shape shown in FIG. 10(*c*) in such a manner that the upper surface of the center portion 33C (the surface on the skin 37 side) projects toward the skin 37

According to the present modified example, the same functions and effects as the third embodiment can be achieved.

In addition, since the frame 33 on the skin 37 side is gently curved in cross-section, an influence (damage) on the skin 37 caused by the frame 33 can be prevented.

Fourth Embodiment

Figure 13:
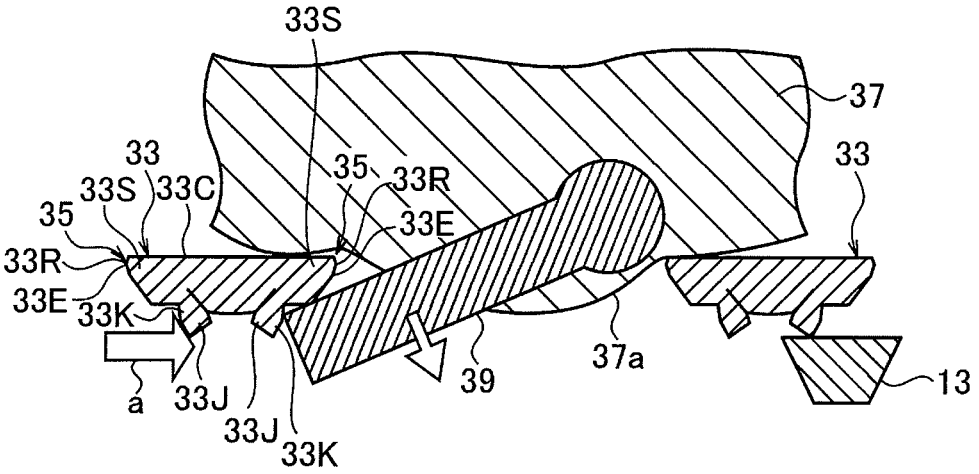
FIG. 13 is a cross-sectional view schematically showing a main part of an electric shaver in a used state according to a fourth embodiment of the present invention.

As shown in FIG. 13, the frame 33 of the outer blade 8 according to the present embodiment is formed into an approximately inverted trapezoidal shape in cross-section in which the both side portions (the circumferences of the blade holes 31 of the frame 33) 33S are tapered and projections 33J are provided on the inner blade 13 side. In addition, the frame 33 is provided with the edges 33E having the rounded portions 33R to serve as the hair lifting portions 35 that have a function to efficiently lift the body hair (the lying body hair) 39 at a small angle to the skin surface 37*a*.

In the present embodiment, as in the case of the preceding embodiments, the entire circumferences of the blade holes 31 of the frame 33 (the both side portions 33S of the frame 33) are bent toward the inner blade 13 so as to provide the hair lifting portions 35 having the rounded portions in the frame 33. In addition, the frame 33 provided with the hair lifting portions 35 is located closer to the skin 37 than to the surface 50 of the inner blade 13 on the skin 37 side (see FIG. 32).

Figure 14:
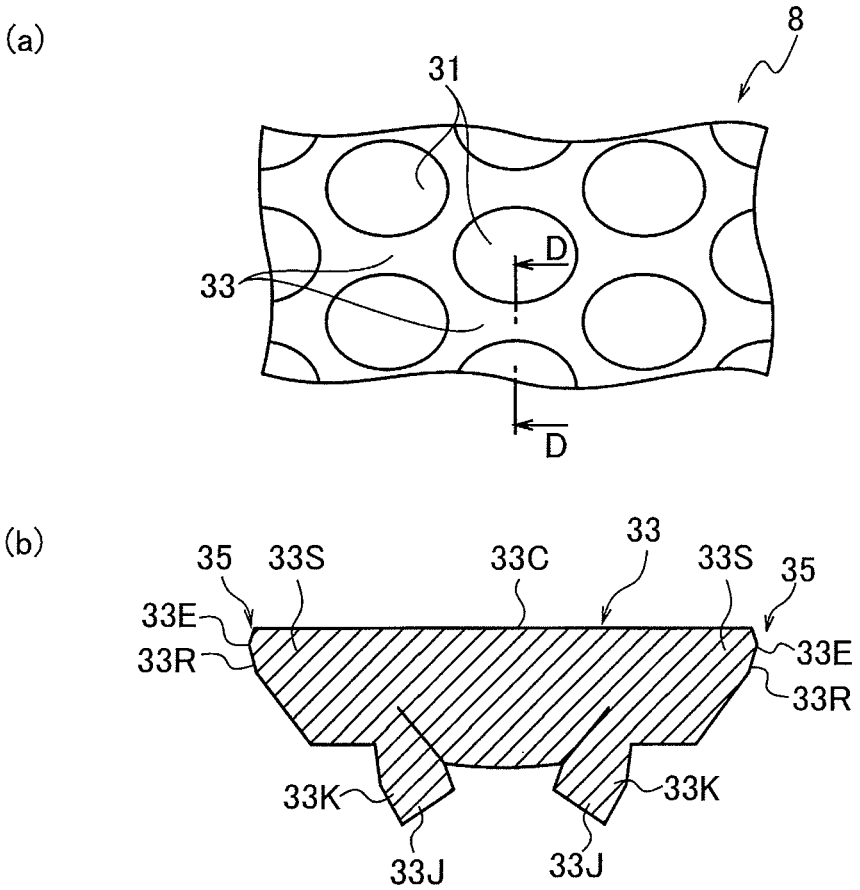
FIG. 14 is a view showing a frame of the electric shaver according to the fourth embodiment of the present invention.

The following is an explanation of a method for manufacturing the hair lifting portions 35 with reference to FIG. 14.

First, as shown in FIG. 14(*a*), the outer blade 8 in which a number of the blade holes 31 having an oval shape are defined by the frame 33 is formed. Next, the frame 33 is formed into an inverse tapered shape in cross-section shown in FIG. 10(*c*). Then, the front ends of the projecting portions 33K are cut and raised toward the inner blade 13. Accordingly, the frame 33 is formed into an approximately inverted trapezoidal shape in cross-section in which the both side portions (the circumferences of the blade holes 31 of the frame 33) 33S are tapered and the projections 33J are provided on the inner blade 13 side as shown in FIG. 14(*b*).

According to the present embodiment, the same functions and effects as the first embodiment can be achieved.

In addition, according to the present embodiment, since the frame 33 is provided with the projections 33J extending toward the inner blade 13, the cross-sectional area of the frame 33 is increased, so that the strength of the frame 33 is improved.

Fifth Embodiment

Figure 15:
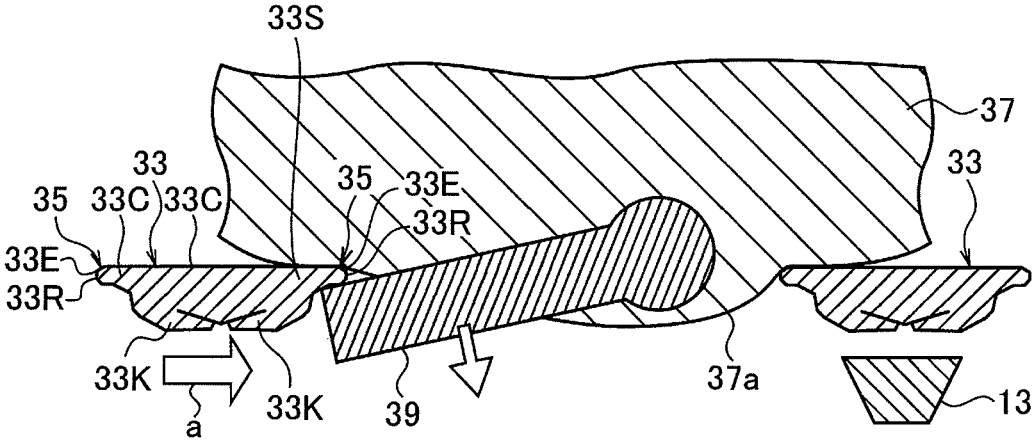
FIG. 15 is a cross-sectional view schematically showing a main part of an electric shaver in a used state according to a fifth embodiment of the present invention.

As shown in FIG. 15, the frame 33 of the outer blade 8 according to the present embodiment is formed into an approximately inverted trapezoidal shape in which the both side portions (the circumferences of the blade holes 31 of the frame 33) 33S are tapered and the edges 33E of the frame 33 extend toward the blade holes 31. In addition, the edges 33E of the frame 33 have the rounded portions 33R on the skin 37 side, and serve as the hair lifting portions 35 that have a function to efficiently lift the body hair (the lying body hair) 39 at a small angle to the skin surface 37*a*.

In the present embodiment, as in the case of the preceding embodiments, the entire circumferences of the blade holes 31 of the frame 33 (the both side portions 33S of the frame 33) are bent toward the inner blade 13 so as to provide the hair lifting portions 35 having the rounded portions in the frame 33. In addition, the frame 33 provided with the hair lifting portions 35 is located closer to the skin 37 than to the surface 50 of the inner blade 13 on the skin 37 side (see FIG. 32).

Figure 16:
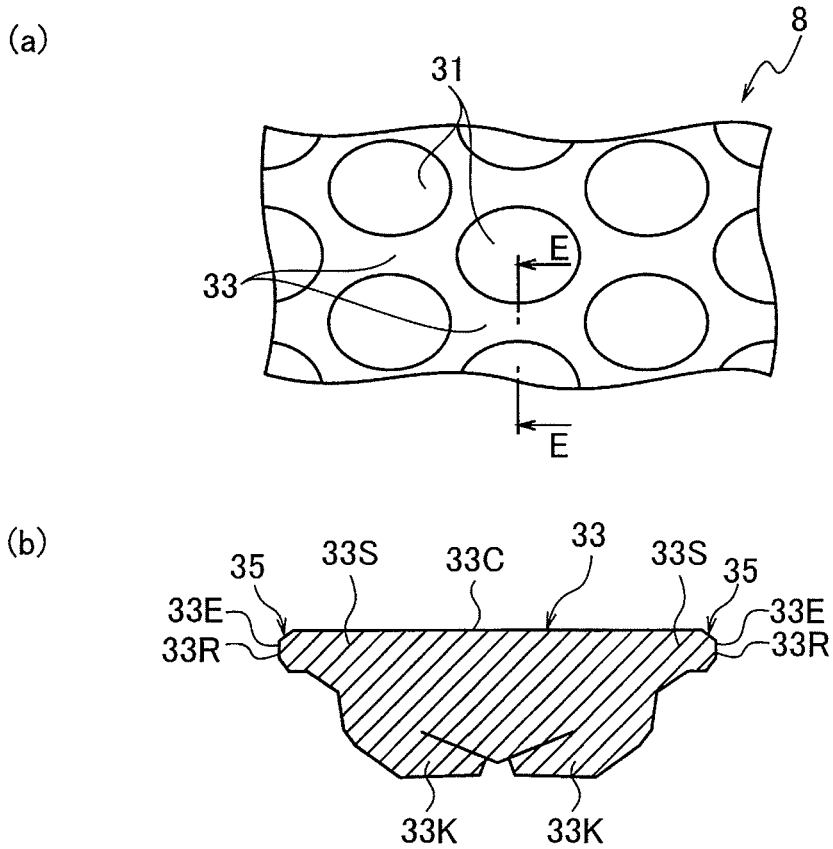
FIG. 16 is a view showing a frame of the electric shaver according to the fifth embodiment of the present invention.

The following is an explanation of a method for manufacturing the hair lifting portions 35 with reference to FIG. 16.

First, as shown in FIG. 16(*a*), the outer blade 8 in which a number of the blade holes 31 having an oval shape are defined by the frame 33 is formed. Next, the frame 33 is formed into an inverse tapered shape in cross-section shown in FIG. 10(*c*). Then, the both side portions of the frame 33 having an inverse tapered shape are pressed toward the skin 37 side from the inner blade 13 side so that the edges 33E of the frame 33 extend toward the blade holes 31 as shown in FIG. 16(*b*).

According to the present embodiment, the same functions and effects as the first embodiment can be achieved.

Since the edges 33E of the frame 33 according to the present embodiment extend toward the blade holes 31, the lying body hair 39 can be easily lifted up by the hair lifting portions 35 to further enhance the effect of lifting the body hair. As a result, the efficiency of shaving the body hair 39 can be further improved.

Sixth Embodiment

Figure 17:
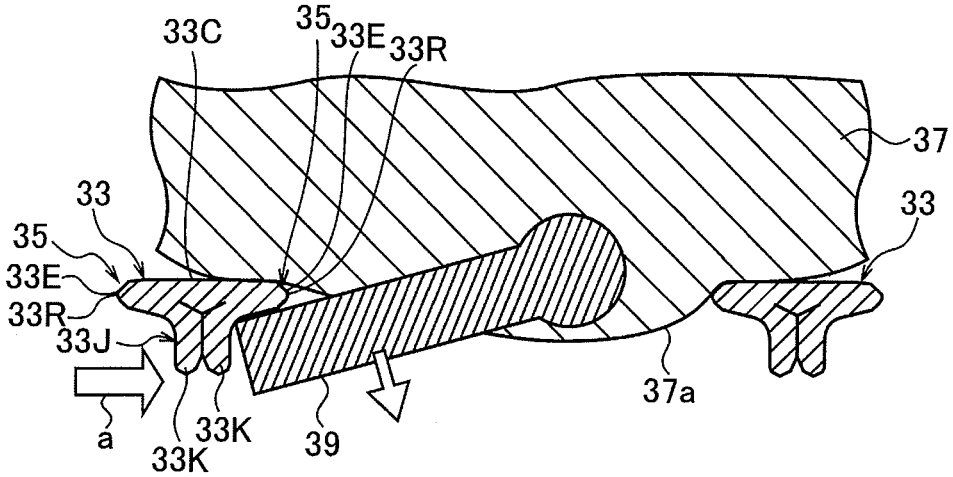
FIG. 17 is a cross-sectional view schematically showing a main part of an electric shaver in a used state according to a sixth embodiment of the present invention.

As shown in FIG. 17, the frame 33 of the outer blade 8 according to the present embodiment is formed into an approximately T-shape in cross-section. In addition, the frame 33 is provided with the edges 33E having the rounded portions 33R to serve as the hair lifting portions 35 that have a function to efficiently lift the body hair (the lying body hair) 39 at a small angle to the skin surface 37*a*.

In the present modified example, as in the case of the preceding embodiments, the entire circumferences of the blade holes 31 of the frame 33 (the both side portions 33S of the frame 33) are bent toward the inner blade 13 so as to provide the hair lifting portions 35 having the rounded portions in the frame 33. In addition, the frame 33 provided with the hair lifting portions 35 is located closer to the skin 37 than to the surface 50 of the inner blade 13 on the skin 37 side (see FIG. 32).

Figure 18:
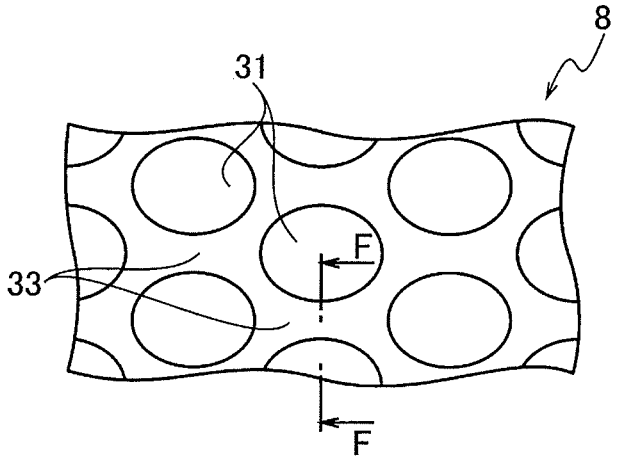
FIG. 18 is a view showing a frame of the electric shaver according to the sixth embodiment of the present invention.
Figure 18:
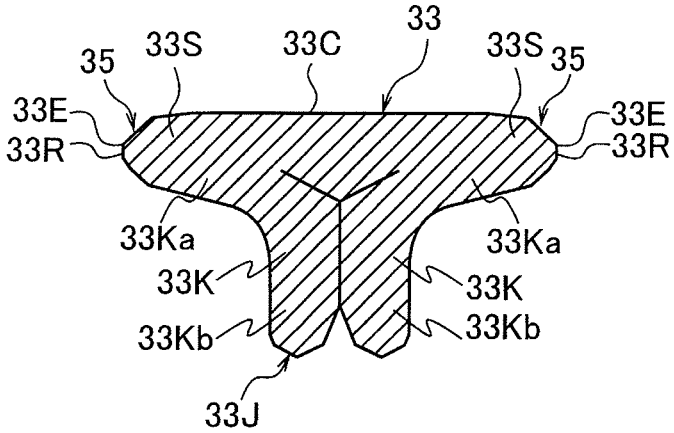

The following is an explanation of a method for manufacturing the hair lifting portions 35 with reference to FIG. 18.

As shown in FIG. 18(*a*), the outer blade 8 in which a number of the blade holes 31 having an oval shape are defined by the frame 33 is formed. In the step of forming the blade holes 31 in the outer blade 8, the frame 33 defining the blade holes 31 of the outer blade 8 is formed into an approximately inverted angular U-shape in cross-section provided with the side walls 33K on both sides of the frame 33.

Then, the load is applied to the middle portions of the both side walls 33K to be bent inward into a crank shape. In this case, base portions 33Ka of the both side walls 33K come into contact with the inner surface of the center portion 33C, and the inner surfaces of front portions 33Kb of the both side walls 33K are pressed against each other, so as to form the frame 33 into an approximately T-shape in cross-section as shown in FIG. 18(*b*). Thus, in the present embodiment, the projections 33J extending toward the inner blades 13 are provided in the frame 33.

According to the present embodiment, the same functions and effects as the first embodiment can be achieved.

In addition, according to the present embodiment, since the frame 33 is provided with the projections 33J extending toward the inner blade 13, the cross-sectional area of the frame 33 is increased, so that the strength of the frame 33 is improved.

Further, according to the present embodiment, the side walls 33K of the frame 33 having an inverted angular U-shape in cross-section are processed so that the frame 33 is formed into an approximately T-shape. Therefore, the frame 33 can be easily processed and accordingly, the products at a lower cost can be provided.

Seventh Embodiment

Figure 19:
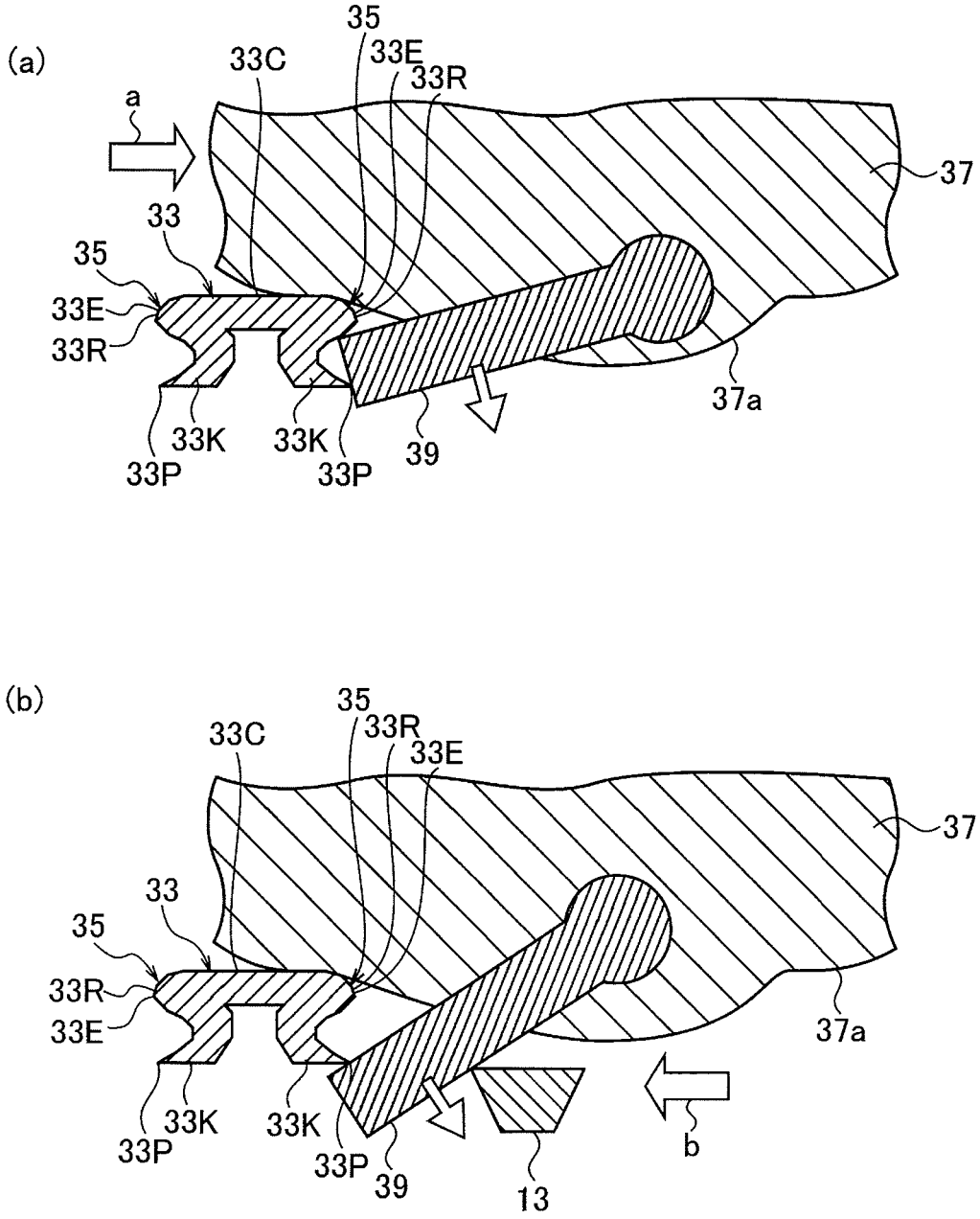
FIG. 19 is a view schematically showing an electric shaver in a used state according to a seventh embodiment of the present invention.

As shown in FIG. 19, the frame 33 of the outer blade 8 according to the present embodiment is formed into an approximately π-shape in cross-section. In addition, the both side portions (the circumferences of the blade holes 31 of the frame 33) 33S of the frame 33 are provided with the edges 33E having the rounded portions 33R to serve as the hair lifting portions 35 that have a function to efficiently lift the body hair (the lying body hair) 39 at a small angle to the skin surface 37*a*.

In the present embodiment, as in the case of the preceding embodiments, the entire circumferences of the blade holes 31 of the frame 33 (the both side portions 33S of the frame 33) are bent toward the inner blade 13 so as to provide the hair lifting portions 35 having the rounded portions in the frame 33. In addition, the frame 33 provided with the hair lifting portions 35 is located closer to the skin 37 than to the surface 50 of the inner blade 13 on the skin 37 side (see FIG. 32).

Figure 20:
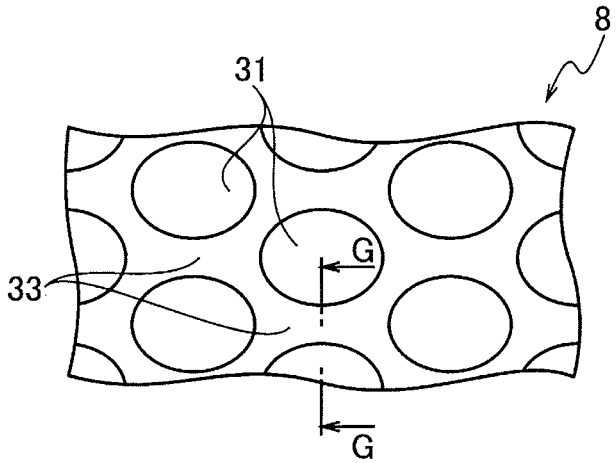
FIG. 20 is a view showing a frame of the electric shaver according to the seventh embodiment of the present invention.
Figure 20:
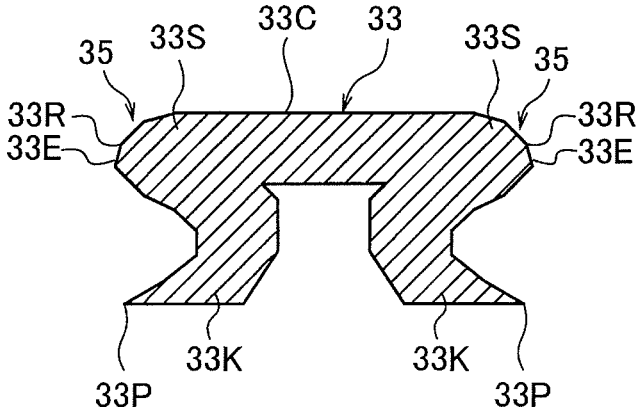

The following is an explanation of a method for manufacturing the hair lifting portions 35 with reference to FIG. 20.

As shown in FIG. 18(*a*), the outer blade 8 in which a number of the blade holes 31 having an oval shape are defined by the frame 33 is formed. In the step of forming the blade holes 31 in the outer blade 8, the frame 33 defining the blade holes 31 of the outer blade 8 is formed into an approximately inverted angular U-shape in cross-section provided with the side walls 33K on both sides thereof.

Then, the middle portions of the both side walls 33K are curved inward so as to form the frame 33 into an approximately π-shape in cross-section as shown in FIG. 20(*b*).

According to the present embodiment, the same functions and effects as the first embodiment can be achieved.

According to the present embodiment, since the frame 33 is formed into an approximately π-shape in cross-section, blade portions 33P having an acute angle on both end portions on the inner blade 13 side are formed. Therefore, the body hair 39 lifted by the hair lifting portions 35 can be cut by the blade portions 33P together with the inner blade 13 (see FIG. 19(*b*)). Note that an arrow b indicates the traveling direction of the inner blade 13. Thus, according to the present embodiment, the one frame 33 can have both the hair lifting function and the hair cutting function.

Further, according to the present embodiment, the side walls 33K of the frame 33 having an inverted angular U-shape in cross-section are processed so as to provide the hair lifting portions 35 and the blade portions 33P. Therefore, the frame 33 can be easily processed and accordingly, the products at a lower cost can be provided.

Eighth Embodiment

Figure 21:
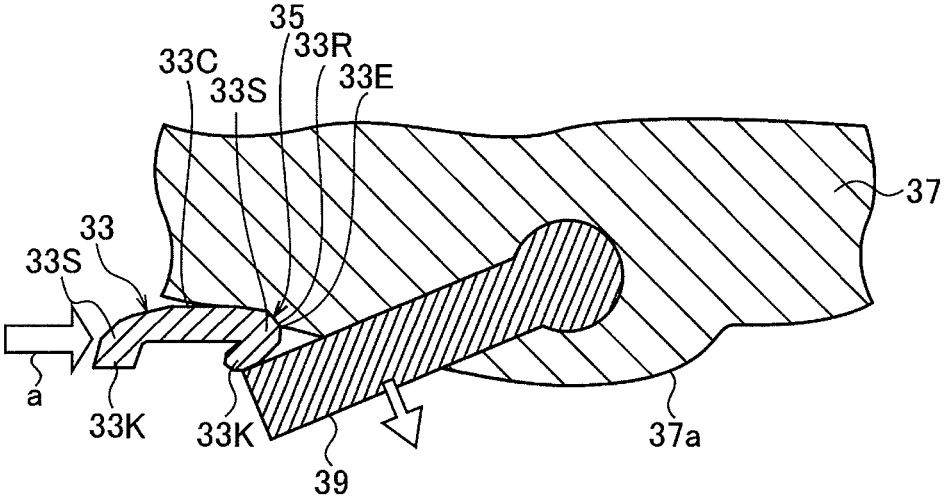
FIG. 21 is a cross-sectional view schematically showing a main part of an electric shaver in a used state according to an eighth embodiment of the present invention.

As shown in FIG. 21, the frame 33 of the outer blade 8 according to the present embodiment has a tapered shape in cross-section only in one side portion (the circumference of the blade hole 31 of the frame 33) 33S of the frame 33. In addition, the one side portion (the circumference of the blade hole 31 of the frame 33) 33S of the frame 33 is provided with the edge 33E formed into an inverse tapered shape and having the rounded portion 33R to serve as the hair lifting portion 35 that has a function to efficiently lift the body hair (the lying body hair) 39 at a small angle to the skin surface 37*a*.

In the present embodiment, as in the case of the preceding embodiments, the entire circumferences of the blade holes 31 of the frame 33 (the both side portions 33S of the frame 33) are bent toward the inner blade 13 so as to provide the hair lifting portions 35 having the rounded portions in the frame 33. In addition, the frame 33 provided with the hair lifting portions 35 is located closer to the skin 37 than to the surface 50 of the inner blade 13 on the skin 37 side (see FIG. 32).

Figure 22:
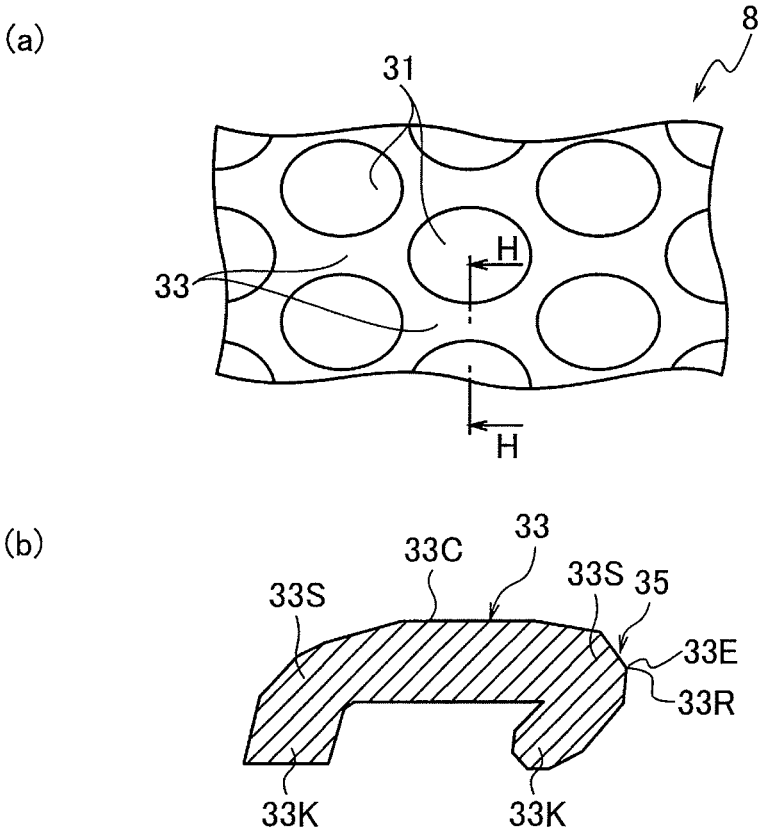
FIG. 22 is a view showing a frame of the electric shaver according to the eighth embodiment of the present invention.

The following is an explanation of a method for manufacturing the hair lifting portions 35 with reference to FIG. 22.

As shown in FIG. 22(*a*), the outer blade 8 in which a number of the blade holes 31 having an oval shape are defined by the frame 33 is formed. In the step of forming the blade holes 31 in the outer blade 8, the frame 33 defining the blade holes 31 of the outer blade 8 is gently curved in such a manner that the upper surface of the center portion (the surface on the skin 37 side) projects toward the skin 37, and is formed into an approximately inverted U-shape in cross-section of which the both side portions (the circumferences of the blade holes 31 of the frame 33) project toward the inner blade 13 (the opposite side of the skin 37).

Then, the load is applied to the projecting portion 33K on one side from the inner blade 13 side so as to form the frame 33 into an inverse tapered shape in cross-section of which one edge 33E has the rounded portion 33R as shown in FIG. 22(*b*).

According to the present embodiment, the same functions and effects as the first embodiment can be achieved.

In the present embodiment, the frame 33 is formed into an inverse tapered shape in cross-section provided with the edge 33E on the skin 37 side. As a result, the edge 33E serving as the hair lifting portion 35 is easily inserted into the gap between the lying body hair 39 and the skin surface 37*a* and therefore, the body hair (the lying body hair) 39 at a small angle to the skin surface 37*a* can be lifted up more efficiently due to the edge 33E.

In addition, since the frame 33 on the skin 37 side is gently curved in cross-section, an influence (damage) on the skin 37 caused by the frame 33 can be prevented.

In the present embodiment, only one side portion (the circumference of the blade hole 31 of the frame 33) 33S of the frame 33 is provided with the hair lifting portion 35 having an inverse tapered shape. Accordingly, the frame 33 can be processed at a low cost.

Ninth Embodiment

Figure 23:
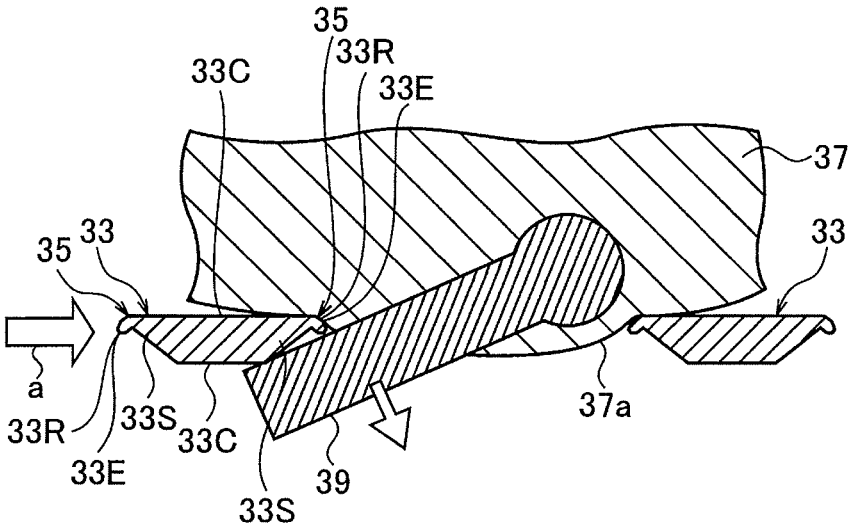
FIG. 23 is a cross-sectional view schematically showing a main part of an electric shaver in a used state according to a ninth embodiment of the present invention.

As shown in FIG. 23, the frame 33 of the outer blade 8 according to the present embodiment is formed into an inverted trapezoidal shape in cross-section having a longer side on the skin 37 side (on the upper side in FIG. 24) and provided with the edges 33E of the both side portions (the circumferences of the blade holes 31 of the frame 33) 33S having the rounded portions 33R. Namely, the frame 33 is provided with the edges 33E having the rounded portions 33R to serve as the hair lifting portions 35 that have a function to efficiently lift the body hair (the lying body hair) 39 at a small angle to the skin surface 37*a*.

In the present embodiment, as in the case of the preceding embodiments, the entire circumferences of the blade holes 31 of the frame 33 (the both side portions 33S of the frame 33) are bent toward the inner blade 13 so as to provide the hair lifting portions 35 having the rounded portions in the frame 33. In addition, the frame 33 provided with the hair lifting portions 35 is located closer to the skin 37 than to the surface 50 of the inner blade 13 on the skin 37 side (see FIG. 32).

Figure 24:
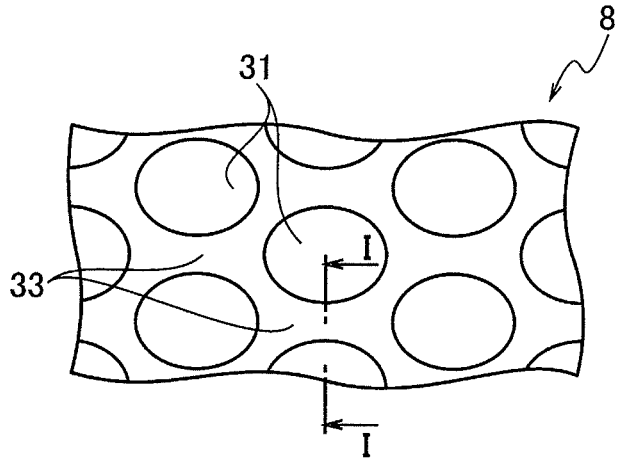
FIG. 24 is a view showing a process of processing a frame of the electric shaver according to the ninth embodiment of the present invention.
Figure 24:
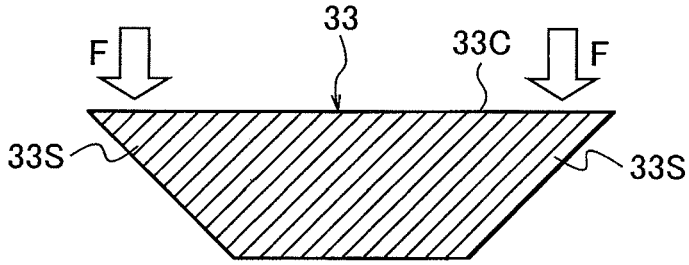
Figure 24:
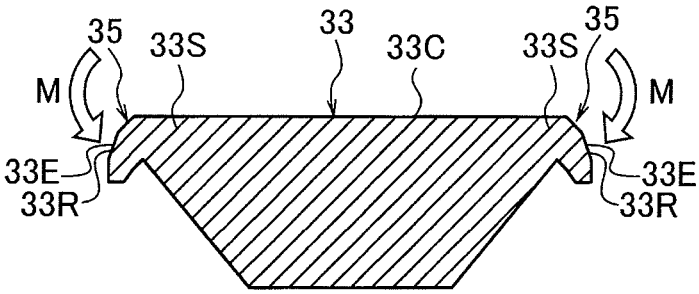

The following is an explanation of a method for manufacturing the hair lifting portions 35 with reference to FIG. 24.

As shown in FIG. 24(*a*), the outer blade 8 in which a number of the blade holes 31 having an oval shape are defined by the frame 33 is formed. In the step of forming the blade holes 31 in the outer blade 8, as shown in FIG. 24(*b*), the frame 33 defining the blade holes 31 of the outer blade 8 is formed into an inverted trapezoidal shape in cross-section having a longer side on the skin 37 side (on the upper side in FIG. 24). Then, the load F is applied from the skin 37 side to the both side portions (the circumferences of the blade holes 31 of the frame 33) 33S having a tapered shape to cause the turning force M, so that the frame 33 is provided with the edges 33E having the rounded portions 33R and formed into the shape in cross-section shown in FIG. 24(*c*).

According to the present embodiment, the same functions and effects as the first embodiment can be achieved.

In addition, according to the present embodiment, since the frame 33 having an inverted trapezoidal shape in cross-section is processed to be provided with the hair lifting portions 35, it is possible to form the frame 33 provided with the edges 33E having the rounded portions 33R only by processing the edges 33E. Therefore, according to the present embodiment, the products can be provided by easy processing at a low cost since the present embodiment requires a small amount of the bending volume.

Tenth Embodiment

Figure 25:
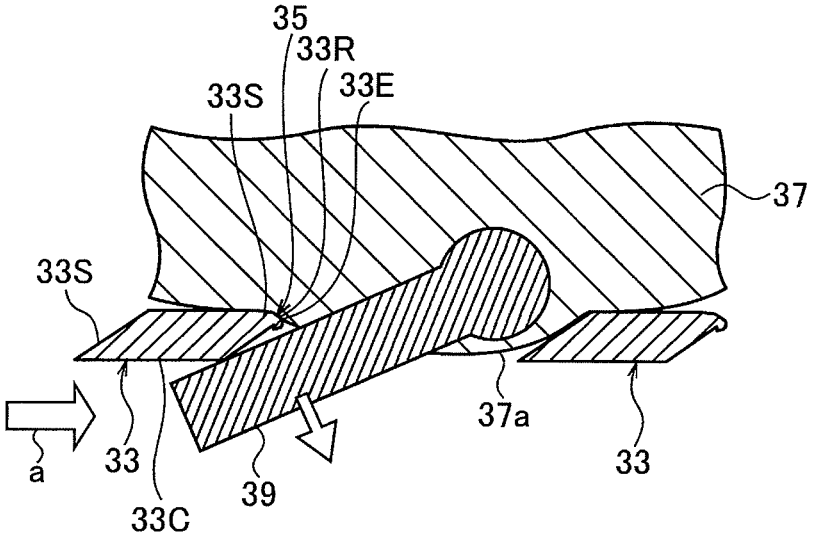
FIG. 25 is a cross-sectional view schematically showing a main part of an electric shaver in a used state according to a tenth embodiment of the present invention.

As shown in FIG. 25, the frame 33 of the outer blade 8 according to the present embodiment is formed into a parallelogram in cross-section, in which one of the side portions (the circumferences of the blade holes 31 of the frame 33) 33S of the frame 33 having an acute angle on the skin 37 side is provided with the edge 33E having the rounded portion 33R. In other words, one of the side portions (the circumferences of the blade holes 31 of the frame 33) 33S of the frame 33 is provided with the edge 33E having the rounded portion 33R to serve as the hair lifting portion 35 that has a function to efficiently lift the body hair (the lying body hair) 39 at a small angle to the skin surface 37*a*.

In the present embodiment, as in the case of the preceding embodiments, the entire circumferences of the blade holes 31 of the frame 33 (the both side portions 33S of the frame 33) are bent toward the inner blade 13 so as to provide the hair lifting portions 35 having the rounded portions in the frame 33. In addition, the frame 33 provided with the hair lifting portions 35 is located closer to the skin 37 than to the surface 50 of the inner blade 13 on the skin 37 side (see FIG. 32).

Figure 26:
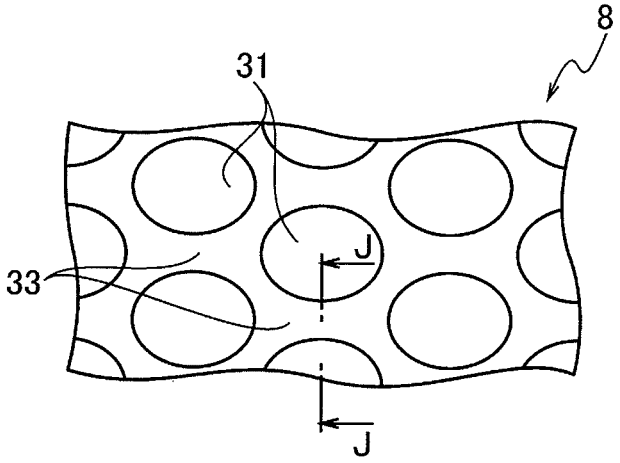
FIG. 26 is a view showing a process of processing a frame of the electric shaver according to the tenth embodiment of the present invention.
Figure 26:
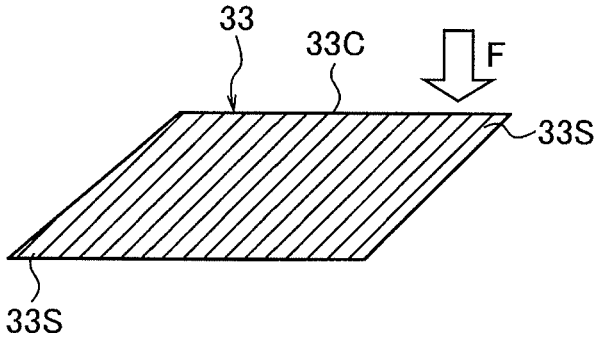
Figure 26:
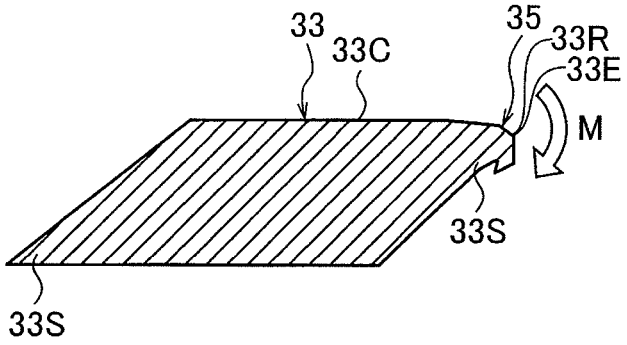

The following is an explanation of a method for manufacturing the hair lifting portions 35 with reference to FIG. 26.

As shown in FIG. 26(*a*), the outer blade 8 in which a number of the blade holes 31 having an oval shape are defined by the frame 33 is formed. In the step of forming the blade holes 31 in the outer blade 8, as shown in FIG. 26(*b*), the frame 33 defining the blade holes 31 of the outer blade 8 is formed into a parallelogram in cross-section. Then, the load F is applied from the skin 37 side to one of the side portions (the circumferences of the blade holes 31 of the frame 33) 33S having an acute angle on the skin 37 side to cause the turning force M, so that the frame 33 is provided with the edge 33E having the rounded portion 33R and formed into the shape in cross-section shown in FIG. 26(*c*).

According to the present embodiment, the same functions and effects as the first embodiment can be achieved.

In addition, according to the present embodiment, the frame 33 formed into a parallelogram in cross-section is provided with the hair lifting portion 35 in such a manner that the edge 33E only on one side is processed to have the rounded portion 33R so as to form the frame 33 into the shape in cross-section shown in the figure. Therefore, according to the present embodiment, the products can be provided by easy processing at a low cost since the present embodiment requires a small amount of the bending volume.

Eleventh Embodiment

Figure 27:
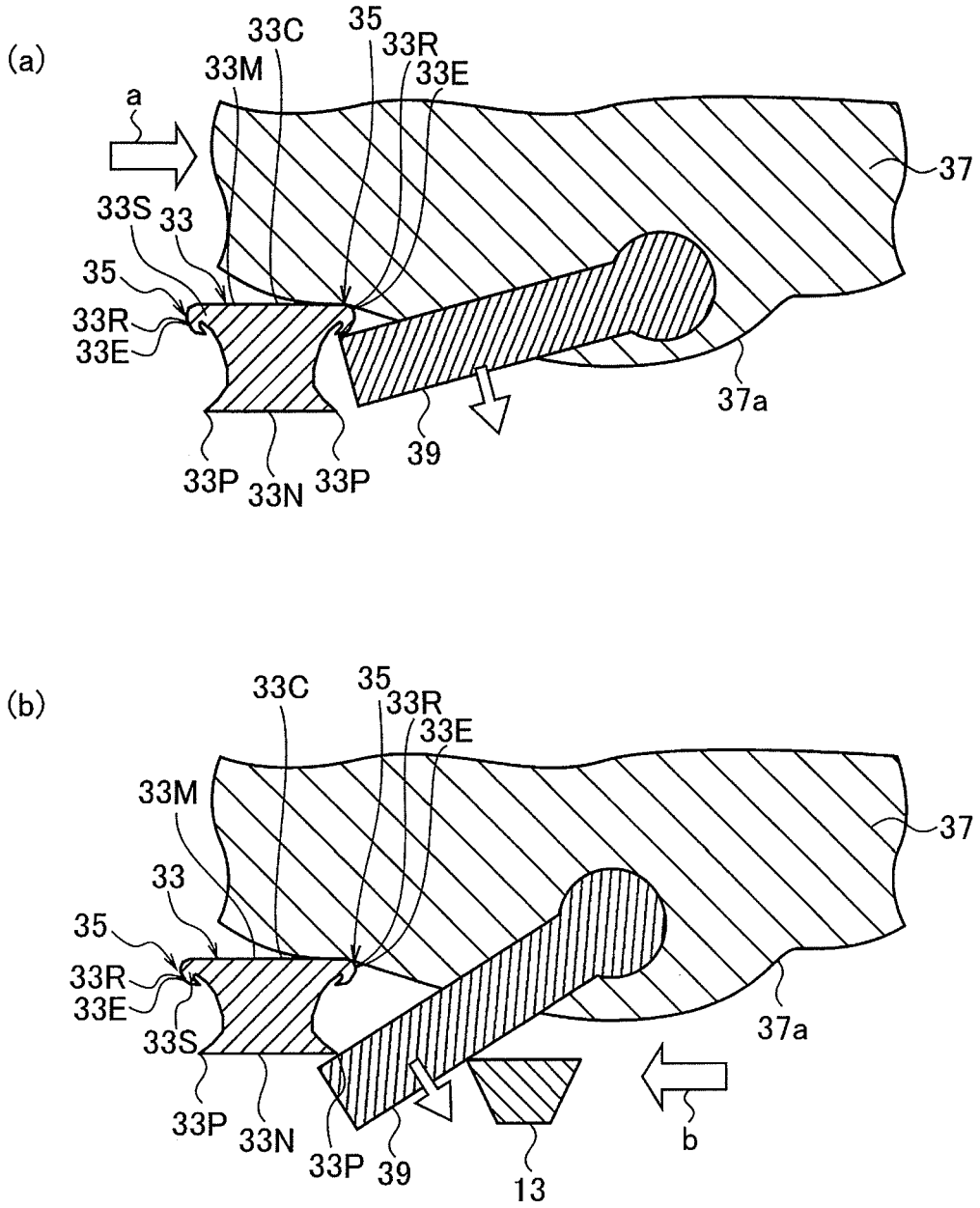
FIG. 27 is a view schematically showing an electric shaver in a used state according to an eleventh embodiment of the present invention.

As shown in FIG. 27, the frame 33 of the outer blade 8 according to the present embodiment is formed into an approximately I-shape in cross-section having a longer side 33M on the skin 37 side than the other side 33N. In particular, the frame 33 is provided with the edges 33E having the rounded portions 33R on the both side portions (the circumferences of the blade holes 31 of the frame) 33S of the longer side 33M on the skin 37 side. In other words, the both side portions (the circumferences of the blade holes 31 of the frame) 33S of the frame 33 is provided with the edges 33E having the rounded portions 33R to serve as the hair lifting portions 35 that have a function to efficiently lift the body hair (the lying body hair) 39 at a small angle to the skin surface 37*a*.

In the present embodiment, as in the case of the preceding embodiments, the entire circumferences of the blade holes 31 of the frame 33 (the both side portions 33S of the frame 33) are bent toward the inner blade 13 so as to provide the hair lifting portions 35 having the rounded portions in the frame 33. In addition, the frame 33 provided with the hair lifting portions 35 is located closer to the skin 37 than to the surface 50 of the inner blade 13 on the skin 37 side (see FIG. 32).

Figure 28:
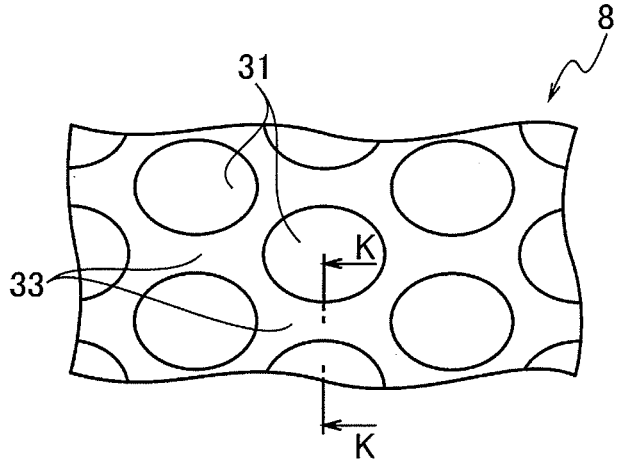
FIG. 28 is a view showing a process of processing a frame of the electric shaver according to the eleventh embodiment of the present invention.
Figure 28:
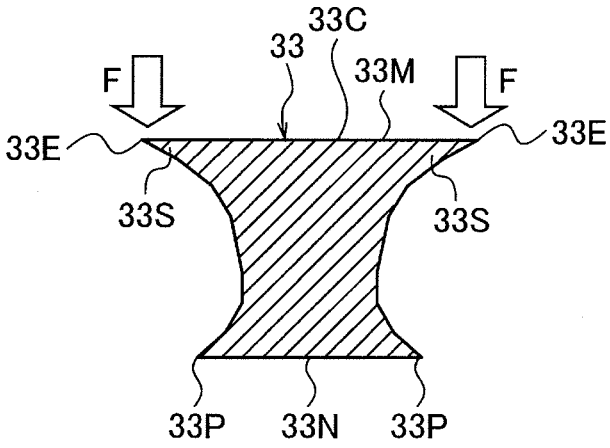
Figure 28:
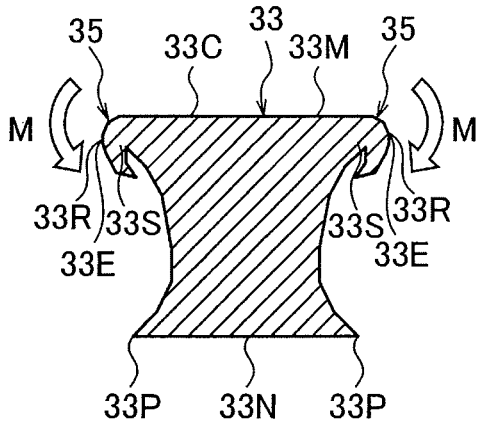

The following is an explanation of a method for manufacturing the hair lifting portions 35 with reference to FIG. 28.

As shown in FIG. 28(*a*), the outer blade 8 in which a number of the blade holes 31 having an oval shape are defined by the frame 33 is formed. In the step of forming the blade holes 31 in the outer blade 8, as shown in FIG. 28(*b*), the frame 33 defining the blade holes 31 of the outer blade 8 is formed into an approximately I-shape in cross-section having the longer side 33M on the skin 37 side than the other side 33N. Then, the load F is applied from the skin 37 side to the both side portions (the circumferences of the blade holes 31 of the frame 33) 33S having a tapered shape to cause the turning force M, so that the frame 33 is provided with the edges 33E having the rounded portions 33R and formed into the shape in cross-section shown in FIG. 28(*c*).

According to the present embodiment, the same functions and effects as the first embodiment can be achieved.

According to the present embodiment, since the frame 33 is formed into an I-shape in cross-section, the blade portions 33P having an acute angle on both end portions of the other side 33N are formed. Therefore, the body hair 39 lifted by the hair lifting portions 35 can be cut by the blade portions 33P together with the inner blade 13 (see FIG. 27(*b*)). Note that the arrow b indicates the traveling direction of the inner blade 13. Thus, according to the present embodiment, the one frame 33 can have both the hair lifting function and the hair cutting function.

Next, a modified example of the frame of the present embodiment will be described with reference to FIG. 29.

Figure 29:
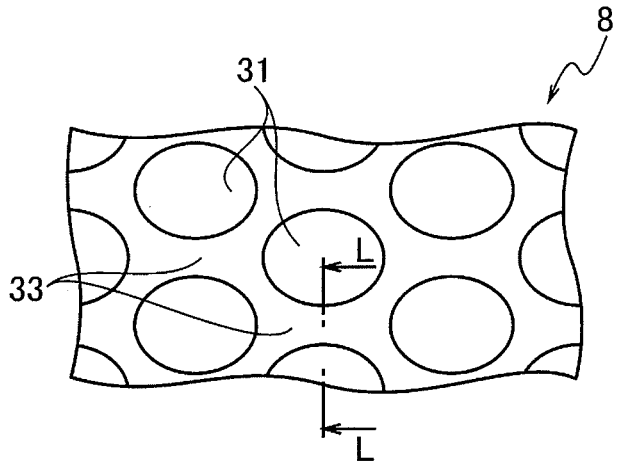
FIG. 29 is a view showing a process of processing a frame of an electric shaver according to a modified example of the eleventh embodiment of the present invention.
Figure 29:
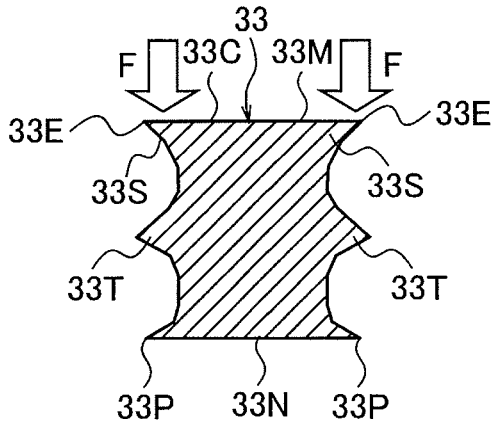
Figure 29:
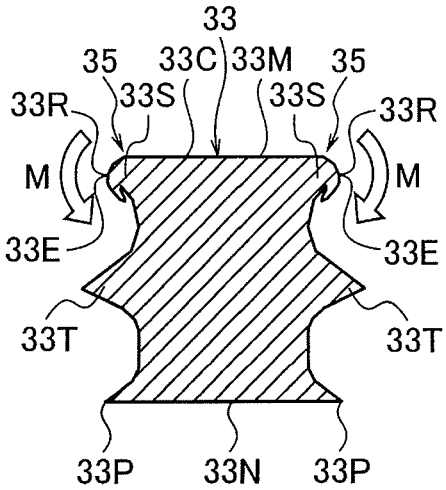

As shown in FIG. 29(*c*), the frame 33 according to the modified example of the present embodiment is formed into an approximately I-shape in cross-section having the longer side 33M on the skin 37 side than the other side 33N and provided with protrusions 33T in the middle of each side surface of the frame 33. In addition, the both side portions (the circumferences of the blade holes 31 of the frame 33) 33S of the frame 33 are provided with the edges 33E having the rounded portions 33R to serve as the hair lifting portions 35 that have a function to efficiently lift the body hair (the lying body hair) 39 at a small angle to the skin surface 37*a*.

In the present modified example, as in the case of the preceding embodiments, the entire circumferences of the blade holes 31 of the frame 33 (the both side portions 33S of the frame 33) are bent toward the inner blade 13 so as to provide the hair lifting portions 35 having the rounded portions in the frame 33. In addition, the frame 33 provided with the hair lifting portions 35 is located closer to the skin 37 than to the surface 50 of the inner blade 13 on the skin 37 side (see FIG. 32).

The following is an explanation of a method for manufacturing the hair lifting portions 35 with reference to FIG. 29.

As shown in FIG. 29(*a*), the outer blade 8 in which a number of the blade holes 31 having an oval shape are defined by the frame 33 is formed. In the step of forming the blade holes 31 in the outer blade 8, as shown in FIG. 29(*b*), the frame 33 defining the blade holes 31 of the outer blade 8 is formed into an approximately I-shape in cross-section provided with the protrusions 33T in the middle of each side surface of the frame 33. Then, the load F is applied from the skin 37 side to the both side portions (the circumferences of the blade holes 31 of the frame 33) 33S having a tapered shape to cause the turning force M, so that the frame 33 is provided with the edges 33E having the rounded portions 33R and formed into the shape in cross-section shown in FIG. 29(*c*).

According to the present modified example, the same functions and effects as the eighth embodiment can be achieved.

Further, according to the present modified example, since the protrusions 33T are provided on the side surfaces of the frame 33, the strength of the frame 33 can be improved.

Twelfth Embodiment

Figure 30:
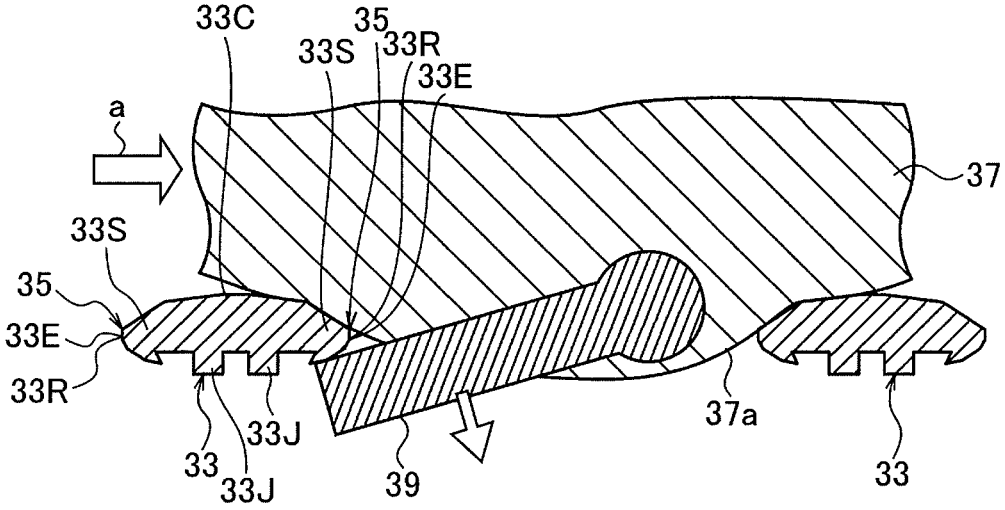
FIG. 30 is a cross-sectional view schematically showing a main part of an electric shaver in a used state according to a twelfth embodiment of the present invention.

As shown in FIG. 30, the frame 33 of the outer blade 8 according to the present embodiment is formed into an approximately barrel-vaulted shape in cross-section having a gently-curved line on the skin 37 side and having the both side portions (the circumferences of the blade holes 31 of the frame 33) 33S bent inward and toward the inner blade 13. In addition, the frame 33 is provided with the edges 33E having the rounded portions 33R to serve as the hair lifting portions 35 that have a function to efficiently lift the body hair (the lying body hair) 39 at a small angle to the skin surface 37*a*.

In the present embodiment, as in the case of the preceding embodiments, the entire circumferences of the blade holes 31 of the frame 33 (the both side portions 33S of the frame 33) are bent toward the inner blade 13 so as to provide the hair lifting portions 35 having the rounded portions in the frame 33. In addition, the frame 33 provided with the hair lifting portions 35 is located closer to the skin 37 than to the surface 50 of the inner blade 13 on the skin 37 side (see FIG. 32).

Figure 31:
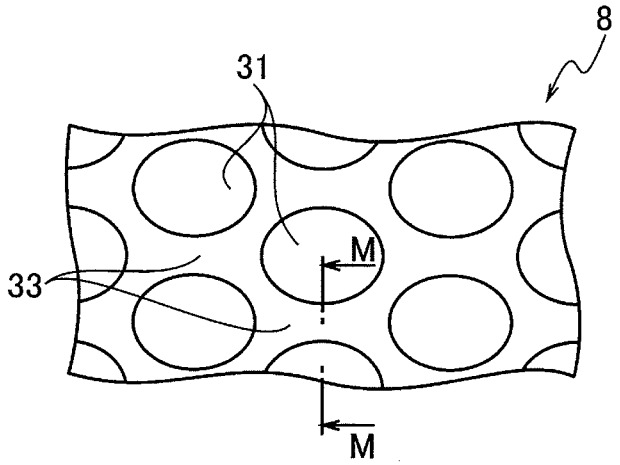
FIG. 31 is a view showing a process of processing a frame of the electric shaver according to the twelfth embodiment of the present invention.
Figure 31:
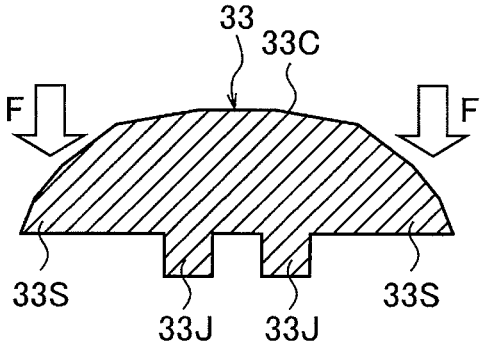
Figure 31:
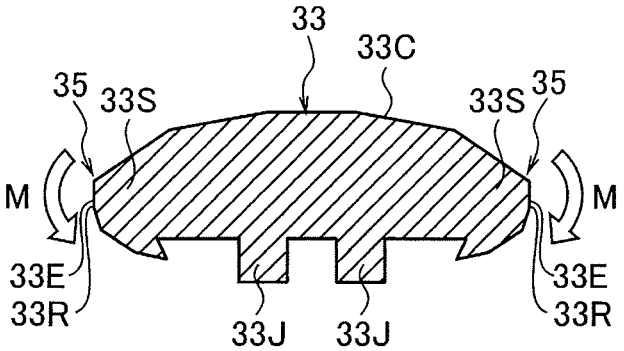

The following is an explanation of a method for manufacturing the hair lifting portions 35 with reference to FIG. 31.

As shown in FIG. 31(*a*), the outer blade 8 in which a number of the blade holes 31 having an oval shape are defined by the frame 33 is formed. In the step of forming the blade holes 31 in the outer blade 8, as shown in FIG. 31(*b*), the frame 33 defining the blade holes 31 of the outer blade 8 is formed into an approximately barrel-vaulted shape in cross-section having a gently-curved line on the skin 37 side. Then, the load F is applied from the skin 37 side to the both side portions (the circumferences of the blade holes 31 of the frame 33) 33S to cause the turning force M, so as to form the frame 33 into an approximately barrel-vaulted shape in cross-section having a gently-curved line on the skin 37 side and having the both side portions (the circumferences of the blade holes 31 of the frame 33) 33S bent inward and toward the inner blade 13, as shown in FIG. 31(*c*).

According to the present embodiment, the same functions and effects as the first embodiment can be achieved.

Although the projections 33J for reinforcement are formed on the surface of the frame 33 on the inner blade 13 side in the present embodiment, it is not required to provide the projections 33J.

Thirteenth Embodiment

The frame 33 according to the present embodiment (see FIG. 32) will be explained while compared with the frame 33 shown in FIG. 33. Note that the present embodiment will be explained by use of the frame 33 obtained in the third embodiment as an example.

Figure 32:
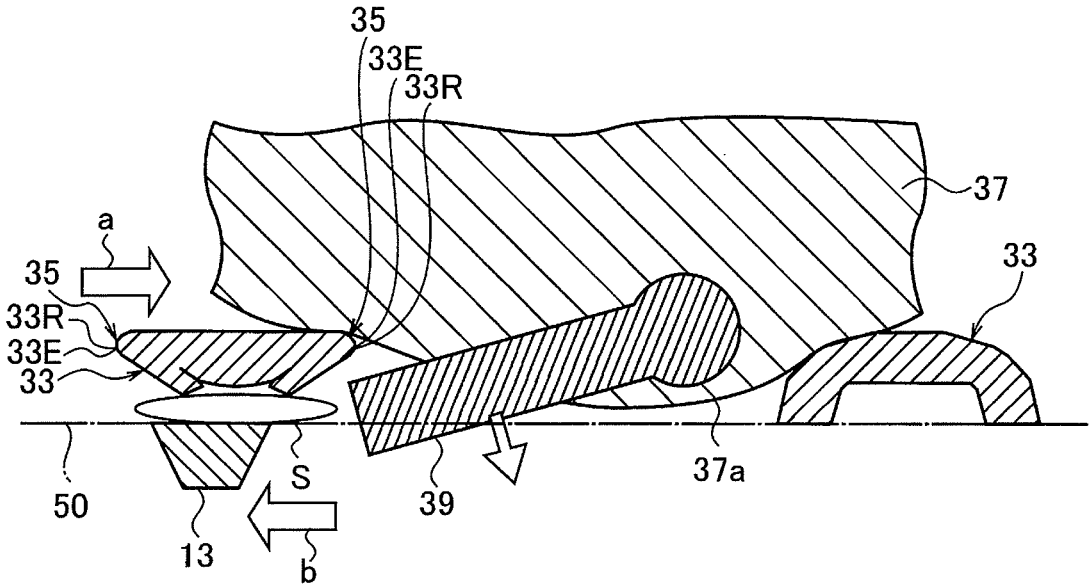
FIG. 32 is a cross-sectional view schematically showing a main part of an electric shaver in a used state according to a thirteenth embodiment of the present invention.

In the present embodiment, as shown in FIG. 32, a space S is provided between the frame 33 provided with the hair lifting portions 35 and the surface 50 of the inner blade 13 on the skin 37 side. In other words, the frame 33 provided with the hair lifting portions 35 is separated from the inner blade 13 and located closer to the skin 37.

Figure 33:
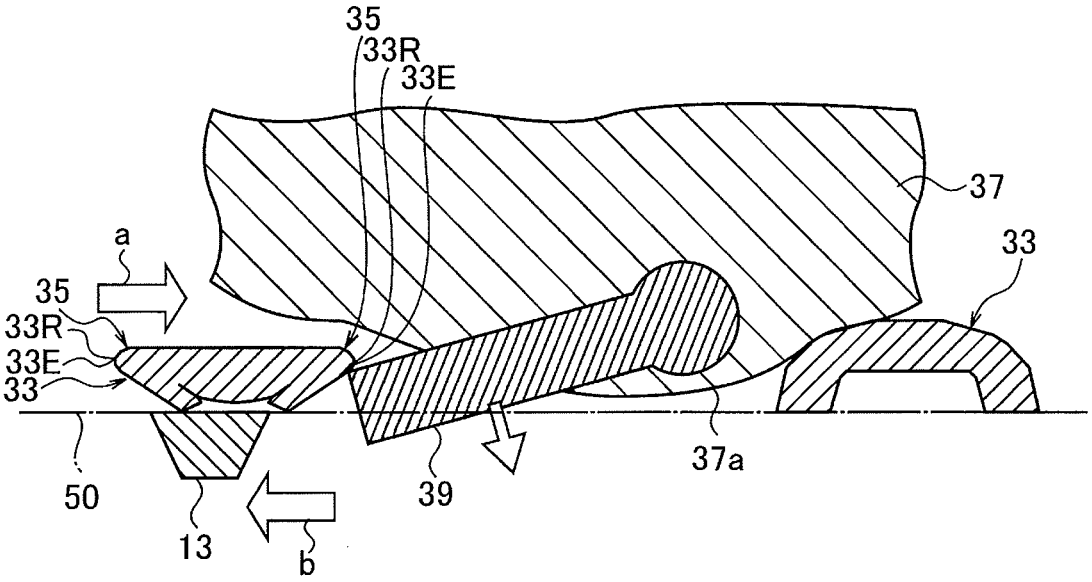
FIG. 33 is a view showing a comparative example compared with the thirteenth embodiment of the present invention, and a cross-sectional view schematically showing a main part of an electric shaver in a used state in which a frame comes into contact with an inner blade.

Meanwhile, the frame 33 shown in FIG. 33 is in contact with the inner blade 13 provided below the frame 33. If the frame 33 is in contact with the inner blade 13, the frame 33 and the inner blade 13 interfere with each other when the inner blade 13 is driven. As a result, an increase in temperature is caused due to the friction between the frame 33 and the inner blade 13.

However, according to the present embodiment, since the space S is provided between the frame 33 and the inner blade 13, the interference between the frame 33 and the inner blade 13 can be prevented so as to suppress the temperature increase due to the friction therebetween.

Although the present embodiment is explained with reference to the frame 33 obtained in the third embodiment, the present embodiment may be applied to the frames of the other embodiments.

Fourteenth Embodiment

Figure 34:
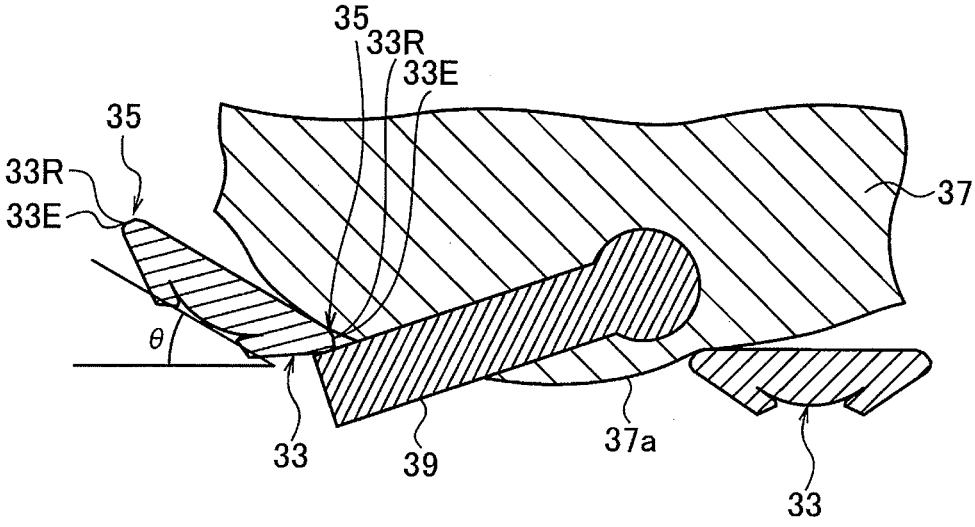
FIG. 34 is a cross-sectional view schematically showing a main part of an electric shaver in a used state according to a fourteenth embodiment of the present invention.

As shown in FIG. 34, the frame 33 according to the present embodiment is inclined at an angle θ to the surface 50 of the inner blade 13 on the skin 37 side.

Since the frame 33 is inclined to the surface 50 of the inner blade 13 on the skin 37 side (the surface including the surface 50 of the inner blade 13 on the skin 37 side), the interference between the frame 33 and the inner blade 13 can be prevented so as to suppress the temperature increase due to the friction therebetween as in the case of the thirteenth embodiment described above. Further, according to the present embodiment, since the edges 33E (the hair lifting portions 35) of the frame 33 easily slide on the skin surface 37*a*, the hair lifting effect can be further improved.

Although the present embodiment is explained with reference to the frame 33 obtained in the third embodiment, the present embodiment may also be applied to the frames of the other embodiments.

Fifteenth Embodiment

In the present embodiment, the edges 33E of the hair lifting portions 35 are partly provided in the circumferences of the blade holes 31.

Figure 35:
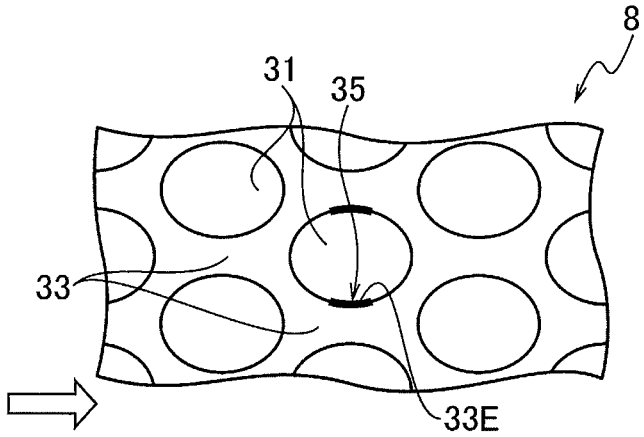
FIG. 35 is an enlarged view schematically showing a main part of an outer blade of an electric shaver according to a fifteenth embodiment of the present invention.

In particular, as shown in FIG. 35, a pair of the edges 33E of the hair lifting portions 35 is provided at the inner periphery of the blade hole 31 facing each other located perpendicular to the moving direction of the inner blade. The portions other than the hair lifting portions 35 are provided with edges having other functions, such as a function to deeply shave the body hair 39.

Thus, according to the present embodiment, since the edges 33E of the hair lifting portions 35 are partly provided at the circumferences of the blade holes 31, each blade hole 31 can have the other functions such as a deep shaving function in addition to the hair lifting function. Accordingly, the efficiency of shaving hair can be further improved.

Sixteenth Embodiment

In the present embodiment, the blade holes 31 of the outer blade 8 are formed into a polygonal shape.

Figure 36:
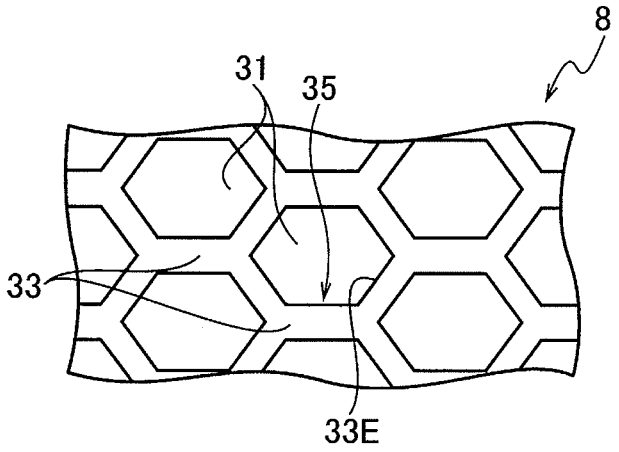
FIG. 36 is a view schematically showing an outer blade of an electric shaver according to a sixteenth embodiment of the present invention.
Figure 36:
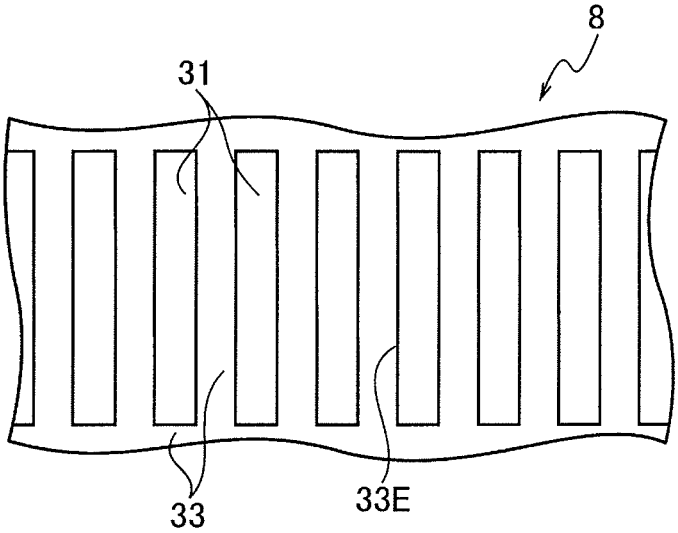

In particular, FIG. 36(*a*) shows the blade holes 31 formed into a hexagonal shape, and FIG. 36(*b*) shows the blade holes 31 formed into a slit-like shape (an elongated rectangular shape). The blade holes 31 having a hexagonal shape and the blade holes 31 having a rectangular shape are respectively provided with the edges 33E of the hair lifting portions 35 at the inner peripheries thereof.

Note that the blade holes 31 are not limited to the hexagonal shape or the rectangular shape, and the blade holes 31 may be formed into other polygonal shapes.

Thus, according to the present embodiment, since the hair lifting portions 35 are provided at the circumferences of the blade holes 31 formed into a polygonal shape, the easy positioning of the frame 33 having the hair lifting effect can be possible at the time of processing. Accordingly, the outer blade 8 with high quality can be provided.

Although the preferred embodiments have been described above, the present invention is not limited to the foregoing embodiments, and various modifications can be made.

For example, the respective embodiments described above include the four outer blades arranged parallel to each other; however, the number of the outer blades may be one to three, or may be five or more.

Although the respective embodiments describe the case in which the outer blades are provided in the head unit fixed to the grip section, the outer blades may be provided in the grip section.

Although the respective embodiments describe the reciprocating electric shaver, the present invention may also be applied to rotary electric shavers.

In addition, the outer blades, the inner blades, and the other specs of the details (for example, shape, dimension and layout) may be modified as necessary.

INDUSTRIAL APPLICABILITY

According to the present invention, the electric shaver capable of improving performance of introduction of the lying body hair into the outer blades while preventing an influence on skin can be obtained.

The invention claimed is:

1. An electric shaver, comprising:

an outer blade including a frame having blade holes therein; and an inner blade provided inside the outer blade to move relative to the outer blade and cut body hair inserted into the blade holes, wherein circumferential edges of the blade holes of the frame are bent toward the inner blade so as to provide hair lifting portions, the hair lifting portions having edges and rounded portions in the frame, wherein the hair lifting portions are provided in portions of the circumference of the blade holes, and wherein the bent circumferential edges providing hair lifting portions comprise a pair of bent circumferential edges provided on the circumference of the blade hole facing each other and located perpendicularly to the moving direction of the inner blade, portions other than the bent circumferential edges are provided with edges to shave the body hair.

2. The electric shaver according to claim 1, wherein the frame is formed into an inverse tapered shape in cross-section and the edges having an acute angle.

3. The electric shaver according to claim 2, wherein the edges the frame project further above a level of a middle portion of the frame.

4. The electric shaver according to claim 3, wherein the frame is provided with projections extending toward the inner blade.

5. The electric shaver according to claim 2, wherein the edges provided in the frame extend toward the blade holes.

6. The electric shaver according to claim 1, wherein a space is provided between the frame provided with the hair lifting portions and the inner blade.

7. The electric shaver according to claim 1, wherein the frame provided with the hair lifting portions is inclined to the surface of the inner blade on the skin side.

* * * * *